US007293762B2

(12) United States Patent
Hoffend, Jr.

(10) Patent No.: US 7,293,762 B2
(45) Date of Patent: Nov. 13, 2007

(54) MODULAR LIFT ASSEMBLY

(75) Inventor: Donald A. Hoffend, Jr., Pittsford, NY (US)

(73) Assignee: Daktronics Hoist, Inc., Brookings, SD (US)

( * ) Notice: Subject to any disclaimer, the term of this patent is extended or adjusted under 35 U.S.C. 154(b) by 0 days.

(21) Appl. No.: 11/463,823

(22) Filed: Aug. 10, 2006

(65) Prior Publication Data

US 2007/0001158 A1 Jan. 4, 2007

Related U.S. Application Data

(63) Continuation of application No. 10/718,871, filed on Nov. 21, 2003, now abandoned, which is a continuation-in-part of application No. 10/274,725, filed on Oct. 19, 2002, now Pat. No. 6,988,716, which is a continuation-in-part of application No. 09/627,537, filed on Jul. 28, 2000, now Pat. No. 6,634,622.

(51) Int. Cl.
*B66D 3/08* (2006.01)

(52) U.S. Cl. ..... 254/394; 254/331; 254/388

(58) Field of Classification Search ..... 254/394, 254/331, 388; 160/331, 344, 143
See application file for complete search history.

(56) References Cited

U.S. PATENT DOCUMENTS

| | | | | |
|---|---|---|---|---|
| 977,499 | A | 12/1910 | Bailey | |
| 977,500 | A | 12/1910 | Bailey | |
| 1,263,628 | A | 4/1918 | Vallen | |
| 1,340,066 | A | 5/1920 | Lemle | |
| 1,473,336 | A | 11/1923 | Connelly | |
| 1,821,563 | A | 9/1931 | Mitchell et al. | |
| 2,357,462 | A | 9/1944 | Ferguson | |
| 2,649,279 | A | 8/1953 | Jones et al. | |
| 4,046,235 | A | 9/1977 | Shutt | |
| 4,062,519 | A | 12/1977 | Jacobs | |
| 4,156,521 | A | 5/1979 | Harman | |
| 4,251,059 | A | 2/1981 | Fougea | |
| 4,324,386 | A | 4/1982 | Gagnon et al. | |
| 4,446,587 | A * | 5/1984 | Jump | 5/83.1 |
| 4,606,527 | A | 8/1986 | Ziller et al. | |

(Continued)

FOREIGN PATENT DOCUMENTS

DE 255 522 4/1988

(Continued)

OTHER PUBLICATIONS

Cyclorama Batten Systems, Regional Performing Arts Center, Philadelphia, PA. Dec. 15, 1999.

(Continued)

*Primary Examiner*—Emmanuel M Marcelo
(74) *Attorney, Agent, or Firm*—Hugh D. Jaeger, Esq.

(57) ABSTRACT

A lift assembly having a drum rotatably mounted to a frame and linearly translatable with respect to the frame. A plurality of head blocks are connected to the frame along a helical mounting path, wherein linear translation of the drum during takeoff or take-up maintains a predetermined fleet angle between a take off point from the drum and the head block. A loft block is disposed within the frame for defining a vertical cable path from within a footprint of the frame.

15 Claims, 39 Drawing Sheets

U.S. PATENT DOCUMENTS

| | | | | |
|---|---|---|---|---|
| 4,662,628 | A | | 5/1987 | Chatenay pouse Compagnone |
| 4,772,923 | A | | 9/1988 | Lein |
| 4,802,787 | A | | 2/1989 | Bays |
| 5,031,574 | A | | 7/1991 | McDowell |
| 5,141,085 | A | | 8/1992 | McCormick |
| 5,361,565 | A | * | 11/1994 | Bayer ..... 254/292 |
| 5,711,713 | A | * | 1/1998 | Krueger ..... 472/77 |
| 6,080,981 | A | | 6/2000 | Payne et al. |
| 6,364,062 | B1 | | 4/2002 | Ericson et al. |
| 6,520,485 | B1 | | 2/2003 | Soot |
| 6,634,622 | B1 | | 10/2003 | Hoffend, Jr. |
| 6,691,986 | B2 | | 2/2004 | Hoffend |
| 6,889,958 | B2 | | 5/2005 | Hoffend |
| 6,988,716 | B2 | | 1/2006 | Hoffend |
| 6,997,442 | B2 | | 2/2006 | Hoffend |
| 2003/0030045 | A1 | | 2/2003 | Hoffend |
| 2003/0111652 | A1 | | 6/2003 | Hoffend |
| 2004/0084665 | A1 | | 5/2004 | Hoffend |
| 2004/0098944 | A1 | | 5/2004 | Hoffend |
| 2004/0099852 | A1 | | 5/2004 | Hoffend |
| 2004/0183060 | A1 | | 9/2004 | Hoffend |
| 2005/0247919 | A1 | | 11/2005 | Hoffend |
| 2006/0169662 | A1 | | 8/2006 | Hoffend |

FOREIGN PATENT DOCUMENTS

| | | |
|---|---|---|
| DE | 37 37 612 | 6/1989 |
| DE | 42 04 153 | 8/1993 |
| DE | 299 12 572 U1 | 9/1999 |
| EP | 0 540 136 | 5/1993 |
| EP | 0 778 239 | 6/1997 |
| FR | 2 689 415 | 10/1993 |

OTHER PUBLICATIONS

English Abstract of publication DE 37 37 612.
English Abstract of publication DE 42 04 153.
English Abstract of publication FR2689415.

* cited by examiner

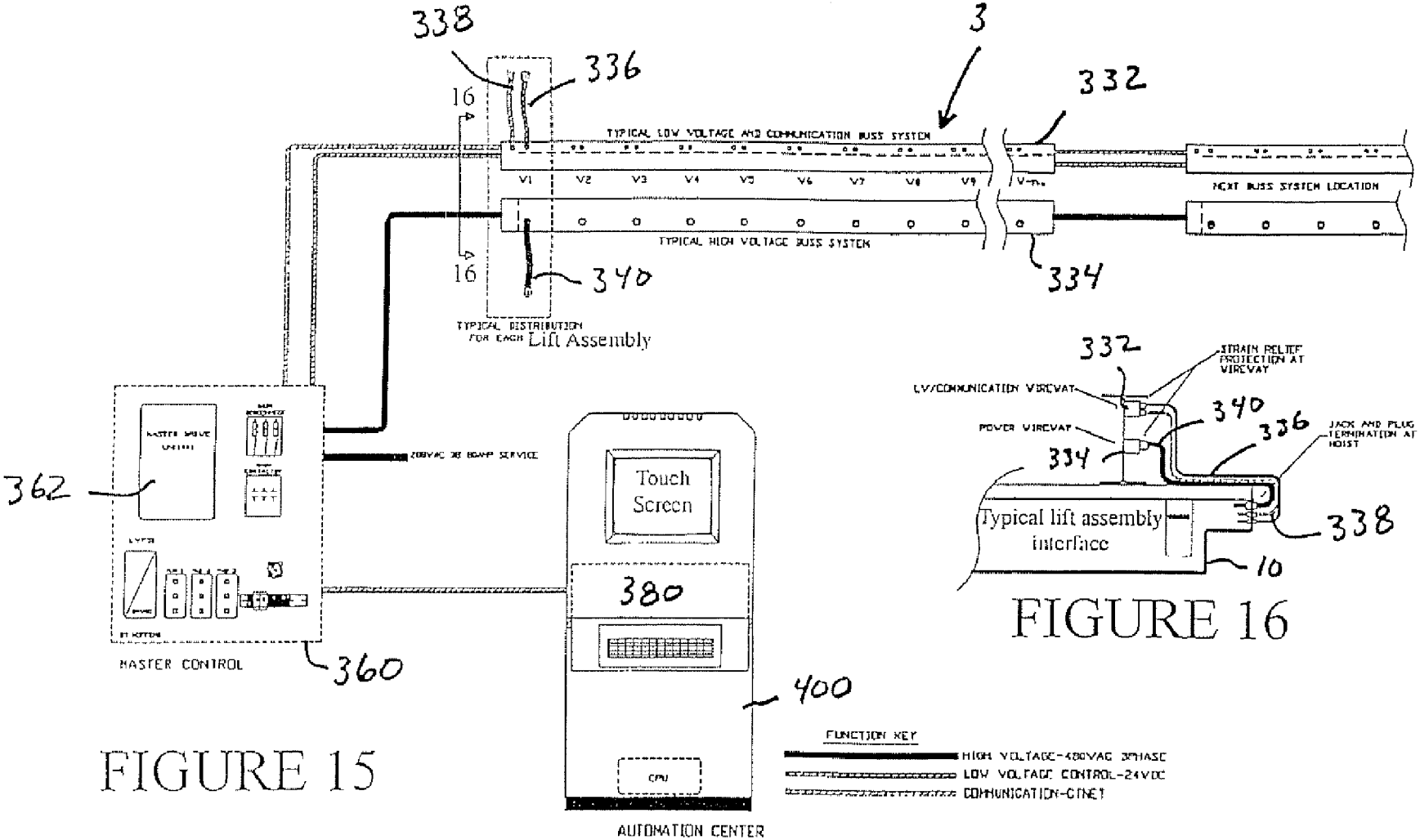
3
332
334
336
338
340
TYPICAL LOW VOLTAGE AND COMMUNICATION BUSS SYSTEM
TYPICAL HIGH VOLTAGE BUSS SYSTEM
NEXT BUSS SYSTEM LOCATION
V1
V2
V3
V4
V5
V6
V7
V8
V9
16
16
TYPICAL DISTRIBUTION FOR EACH Lift Assembly
STRAIN RELIEF PROTECTION AT WIREWAY
JACK AND PLUG COMBINATION AT HOIST
10
LV/COMMUNICATION WIREWAY
POWER WIREWAY
Typical lift assembly interface
FIGURE 16
FUNCTION KEY
HIGH VOLTAGE-480VAC 3PHASE
LOW VOLTAGE CONTROL-24VDC
COMMUNICATION-CANET
400
Touch Screen
380
CPU
AUTOMATION CENTER
208VAC 3Ø 100AMP SERVICE
360
MASTER CONTROL
362
FIGURE 15

FIGURE 55
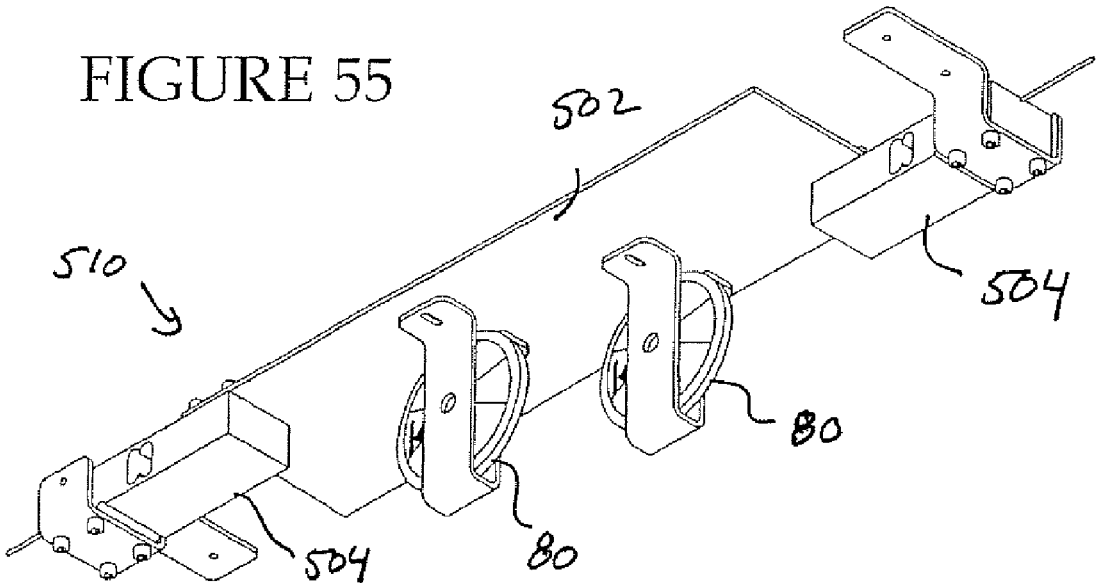
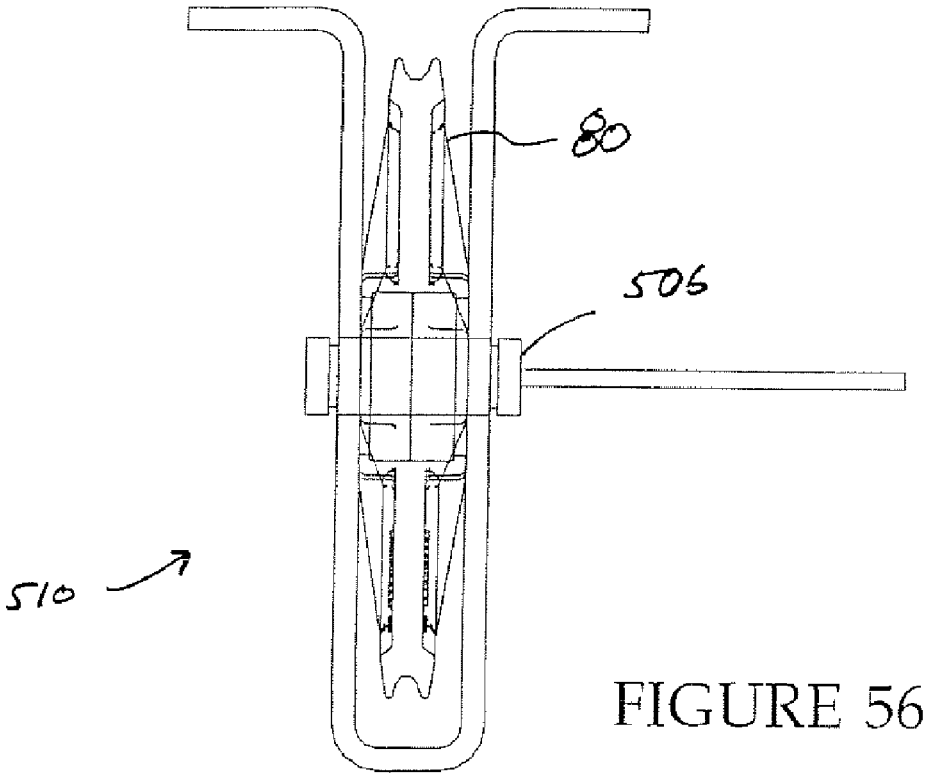
FIGURE 56

MODULAR LIFT ASSEMBLY

CROSS-REFERENCE TO RELATED APPLICATIONS

The present application is a continuation of U.S. application Ser. No. 10/718,871 filed Nov. 21, 2003, now abandoned, which is a continuation-in-part of U.S. application Ser. No. 10/274,725 filed Oct. 19, 2002, now U.S. Pat. No. 6,988,716 which is a continuation-in-part of U.S. application Ser. No. 09/627,537 filed Jul. 28, 2000, now U.S. Pat. No. 6,634,622.

STATEMENT REGARDING FEDERALLY SPONSORED RESEARCH OR DEVELOPMENT

Not applicable.

Reference to A "Sequence Listing"

Not applicable.

BACKGROUND OF THE INVENTION

Performance venues such as theaters, arenas, concert halls, auditoriums, schools, clubs, convention centers and television studios employ battens or trusses to suspend lighting, scenery, drapery and other equipment which is moved relative to a stage or floor. These battens usually include pipe or joined pipe sections that form a desired length of the batten. The battens can be 50 feet or more in length. To support heavy loads or where suspension points are spaced 15-30 feet apart, the battens may be fabricated in either ladder, triangular or box truss configurations.

Battens often need to be lowered for exchanging and servicing the suspended equipment. To reduce the power necessary to raise and lower the battens, the battens are often counterweighted. The counterweights reduce the effective weight of the battens and any associated loads.

A typical counterweight system represents a significant cost. These costs are incurred in building construction, as well as installation. With respect to building construction, existing systems can require from 10,000 as much as 80,000 $ft^3$ above a grid of support beams. This space is solely required and utilized by the rigging system. The installation of prior systems also represents a significant cost. The creation of T-bar wall 70 feet to 80 feet in height and 30 feet deep may require over three weeks. Even after installation of the T-bar wall, head block beams, loading bridges, index lights and hoist systems must be integrated. Therefore, a substantial cost is incurred in the mere installation of a counterweight system, as the total installation time may range from 4 to 6 weeks.

A number of elevating or hoisting systems are available for supporting, raising and lowering battens. One of the most common and least expensive batten elevating systems is a counterweighted carriage which includes a moveable counterweight for counterbalancing the batten and equipment supported on the batten.

Another common elevating or hoisting system employs a winch to raise or lower the battens. Usually hand or electric operated winches are used to raise or lower the battens. Occasionally in expensive operations, a hydraulic or pneumatic motorized winch or cylinder device is used to raise and lower the batten.

Many elevating systems have one or more locking devices and at least one form of overload limiting device. In a counterweight system, a locking device may include a hand operated rope that is attached to one end of the top of the counterweight arbor (carrying device) and then run over a head block, down to the stage, through a hand rope block for locking the counterweight in place, and then around a floor block and back up to the bottom of the counterweight arbor. The hand rope lock locks the rope when either the load connected to the batten or the counterweight loads are being changed and rebalanced and locks the loads when not moving.

In a sandbag counterweight system, the locking device is merely a rope tied off to a stage mounted pin rail, while the overload limit is regulated by the size of the sandbag. In this rigging design, however, a number of additional bags can be added to the set of rope lines, and thereby exceed the safe limit of suspension ropes and defeat the overload-limiting feature.

Hand operated winches will occasionally free run when heavily loaded and will then dangerously drop the suspended load. Other types of hand winches use a ratchet lock, but again these winches are also susceptible to free running when they are heavily loaded and hand operated.

Therefore, the need exists for a lift assembly that can replace traditional counterweight systems. The need further exists for a lift assembly that can be readily installed into a variety of building configurations and layouts. A need further exists for a lift assembly having a modular construction to facilitate configuration to any of a variety of installations. A need also exists for a lift assembly that can maintain a predetermined fleet angle during raising or lowering of a load.

1. Field of the Invention

The present invention relates to lift and hoist mechanisms, more particularly, to a lift assembly that can be employed for raising and lowering a load in theatrical and staging environments, wherein the lift assembly is a modular self contained unit that can be readily installed in a wide variety of building configurations.

2. Description of Related Art

[Click here and type Background Art]

BRIEF SUMMARY OF THE INVENTION

The present invention provides a lift assembly that can be employed in a variety of environments, including but not limited to theater or stage configurations. The present system is also configured to assist in converting traditional counterweight systems to a non-counterweighted system. The present invention further provides a lift assembly that can be configured to lie substantially within the footprint of the associated drop lines.

The present invention includes a lift frame, a plurality of head blocks and at least one loft block connected to the frame, and a drum rotatably connected to the frame about a longitudinal axis of the drum, the drum also being translatable along its longitudinal axis relative to the head blocks to maintain a predetermined fleet angle between the head blocks.

In a further configuration, the present invention may include a bias mechanism such as a torsion spring connected between the frame and the drum for reducing the effective weight of the load or batten and any associated equipment.

The lift assembly of the present invention employs a modular frame for accommodating a different number of head blocks. The lift assembly also includes a modular drum construction which allows for the ready and economical configuration of the system to accommodate various stage sizes. The lift assembly further contemplates the head blocks connected to the frame to be radially spaced about the axis of drum rotation. In a further configuration, the head blocks are radially and longitudinally spaced relative the to axis of drum rotation, to lie in a helical or a serpentine path relative to the drum.

The lift assembly of the present invention further contemplates a load brake for reducing the risks associated with drive or motor failures. In addition, the present invention contemplates a clip assembly for readily engaging the frame with structural beams, which can have any of a variety of dimensions. In addition, a power/control strip is provided for supplying the power to a lift assembly as well as control signals.

The present invention further includes loft blocks for guiding the cable from the modular frame to the battens. In a further configuration, the present invention contemplates selective height or trim adjustment for a section of a batten relative to the respective cable. A further configuration of the present invention provides a safety stop for terminating movement of batten upon detection of an obstacle in an intended travel path of the batten.

It is further contemplated that a configuration of the present invention can include a housing or enclosure substantially surrounding the drum, the motor, the head blocks and any internal loft blocks. The enclosure can include ports for permitting a cable path to vertically descend from a horizontally oriented drum. In addition, the enclosure can include sound deadening or acoustical energy absorbing material, or layers, to reduce the transmission of noise generated by the components within the enclosure.

Further, as the present lift assembly can include one, two or more lift lines vertically descending from within a footprint of the enclosure, the lift assembly can be operably disposed within the array of lift lines, thereby substantially reducing the required space for installation and operation. In addition, the lift assembly can include a backbone such that adjacent lift assemblies can be installed to dispose the backbones in a substantially abutting relationship. As the lift assemblies are clamped to the structural beams, the installed lift assemblies act to enhance the rigidity of the structural beams.

As the lift assembly can be installed within a lift line array or overlapping a portion of the lift line array, the batten can include a pulley or a sheave such that the lift lines descend from the corresponding loft block around the respective pulley on the batten and generally terminate at the respective structural beam, loft block or at the lift assembly. Thus, an effective double purchase can be employed, whereby the effective load that can be raised by a given lift assembly is doubled.

The lift assembly can employ an integrated control system architecture with distributed control for allowing sealing of an entire system. Thus, in certain configurations, a drive control within each lift assembly generates an operating profile to implement a command receive from a master control.

The present invention provides a turnkey lift assembly having rigging; power and control for the manipulation of battens, without requiring construction of traditional counterweight systems or relying on previously installed counterweight systems.

BRIEF DESCRIPTION OF THE SEVERAL VIEWS OF THE DRAWING(S)

Figure 4A:
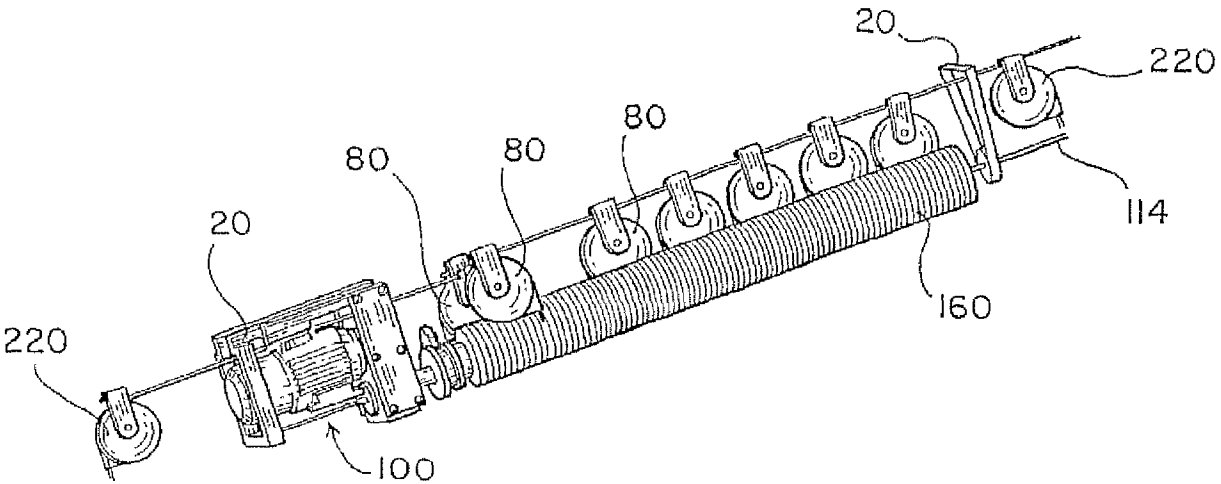

FIG. 4*a* is a perspective view of the connection of the drum, drive mechanism and frame for rotation of the drum and translation of the drum and drive mechanism.

Figure 4B:
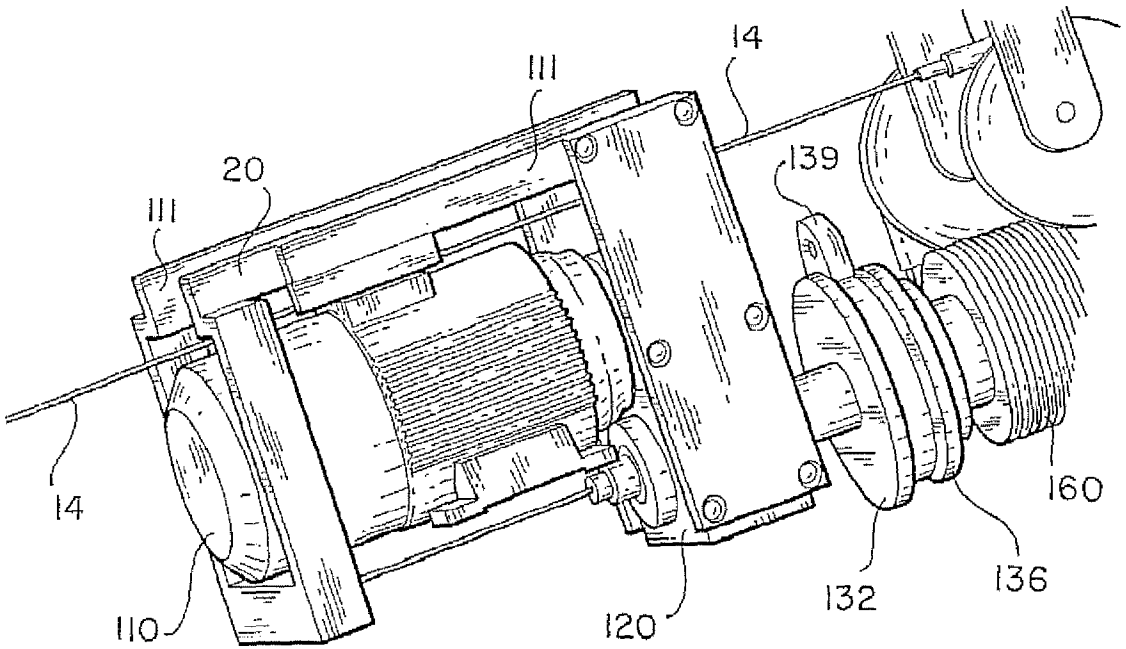

FIG. 4*b* is an enlarged view of a portion of FIG. 4*a*.

Figure 5:
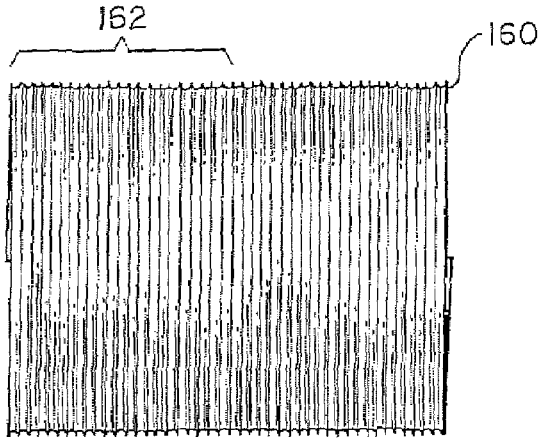

FIG. 5 is a side elevational view of a drum.

Figure 6:
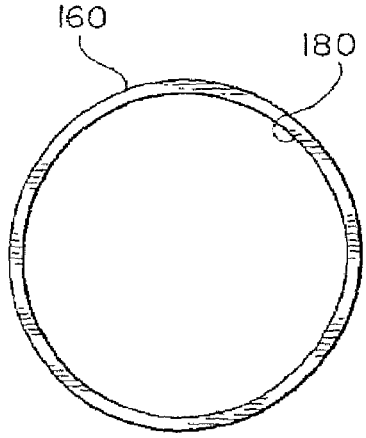

FIG. 6 is an end elevational view of a drum.

Figure 7:
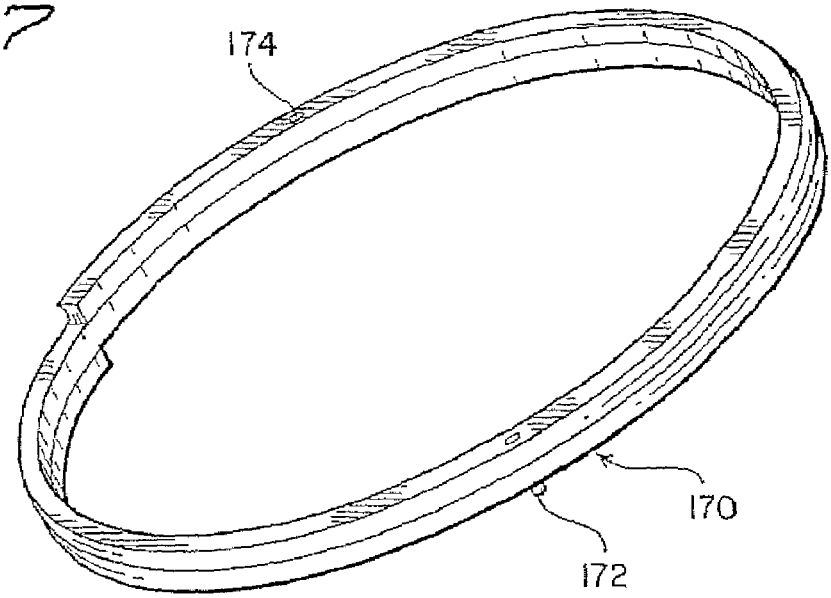

FIG. 7 is a perspective view of a longitudinal drum segment.

Figure 8:
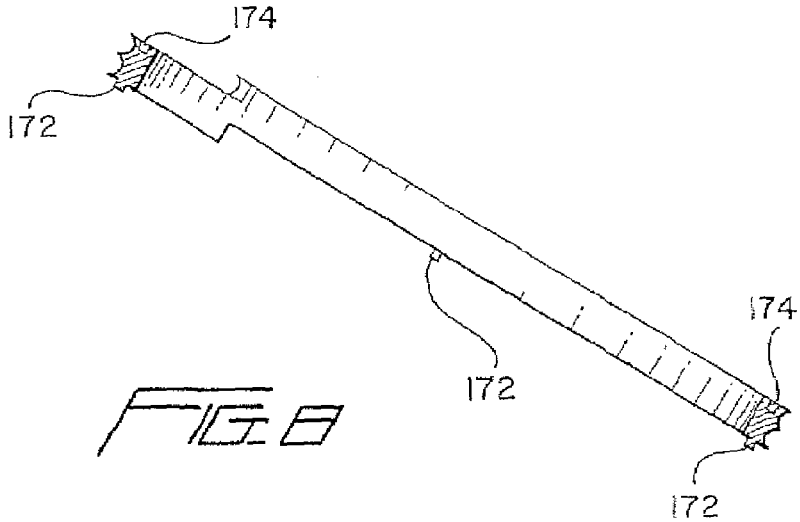

FIG. 8 is a cross-sectional view of a longitudinal drum segment.

Figure 9:
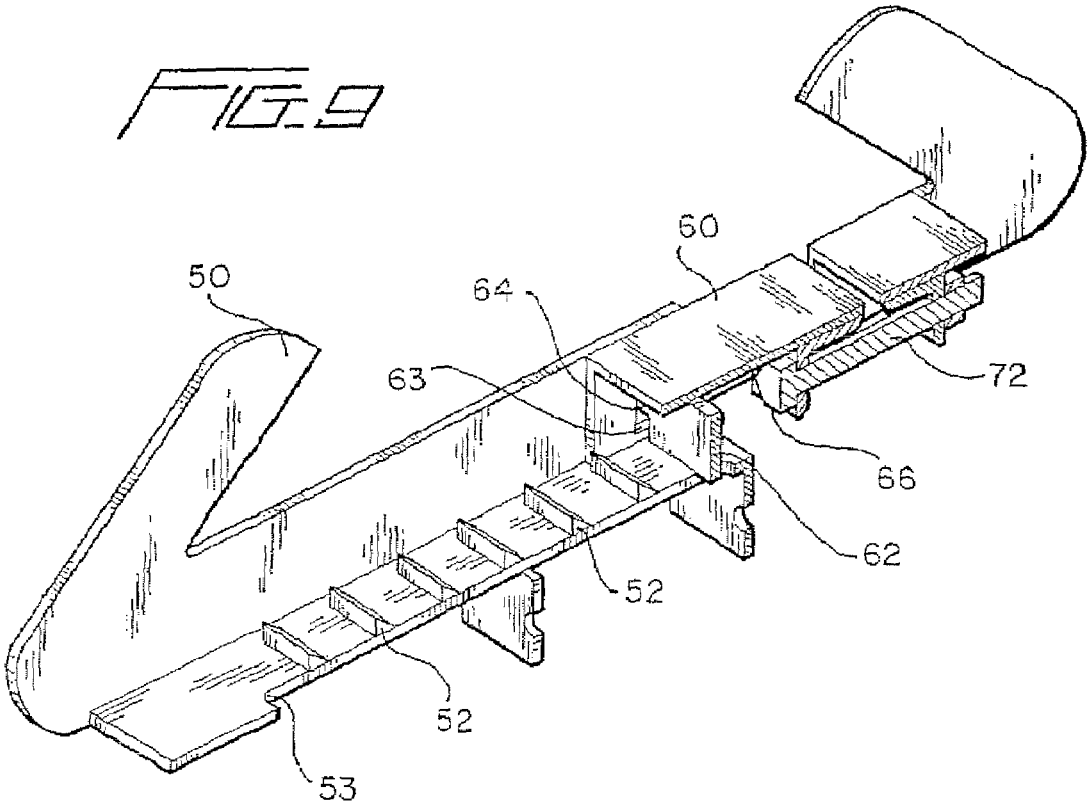

FIG. 9 is a perspective partial cut away view of a clip assembly.

Figure 10:
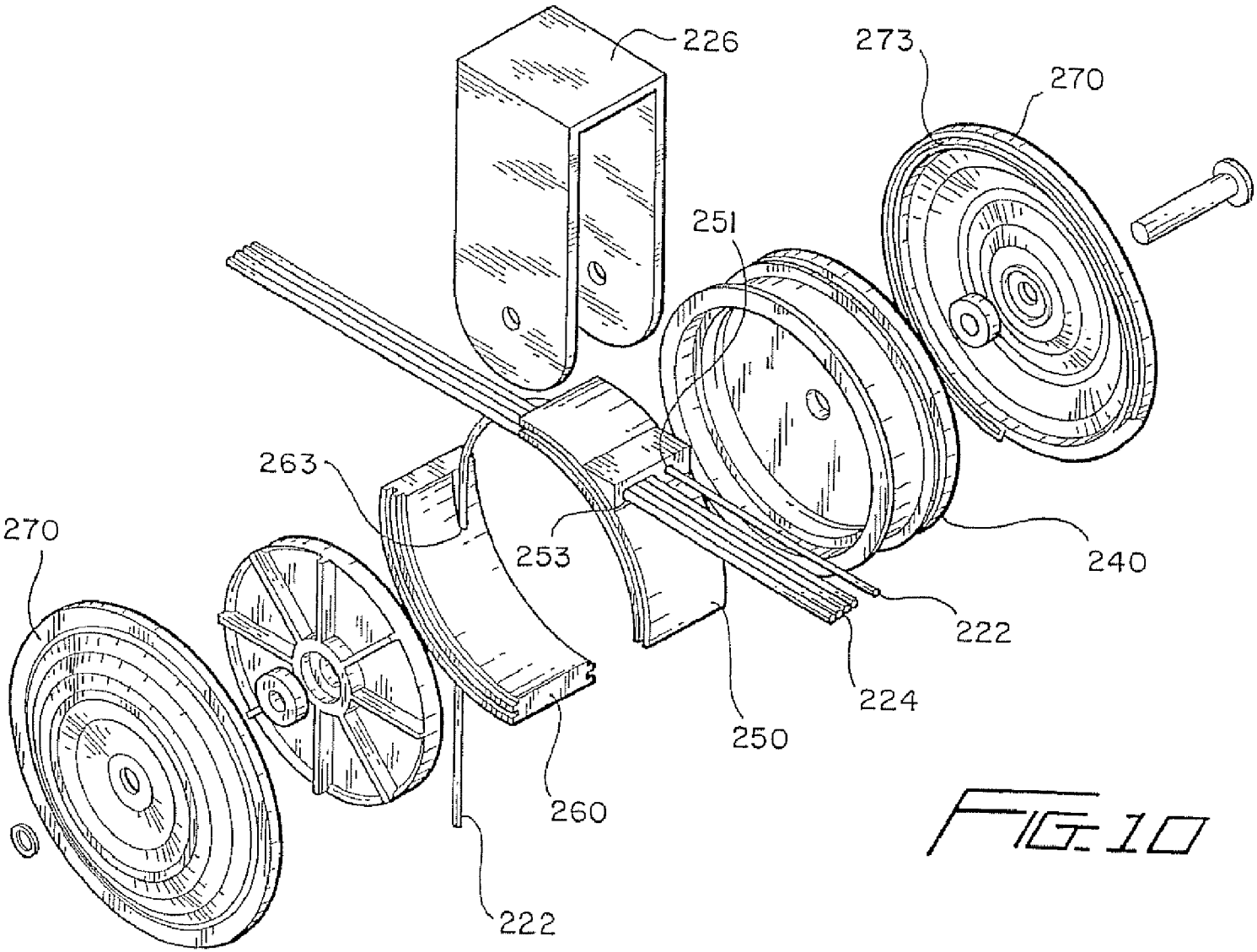

FIG. 10 is an exploded perspective view of a loft block.

Figure 11:
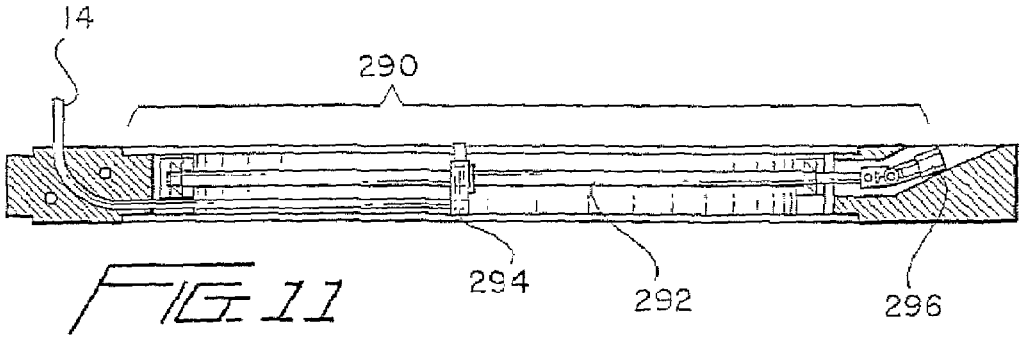

FIG. 11 is a cross-sectional view of the trim adjustment.

Figure 12:
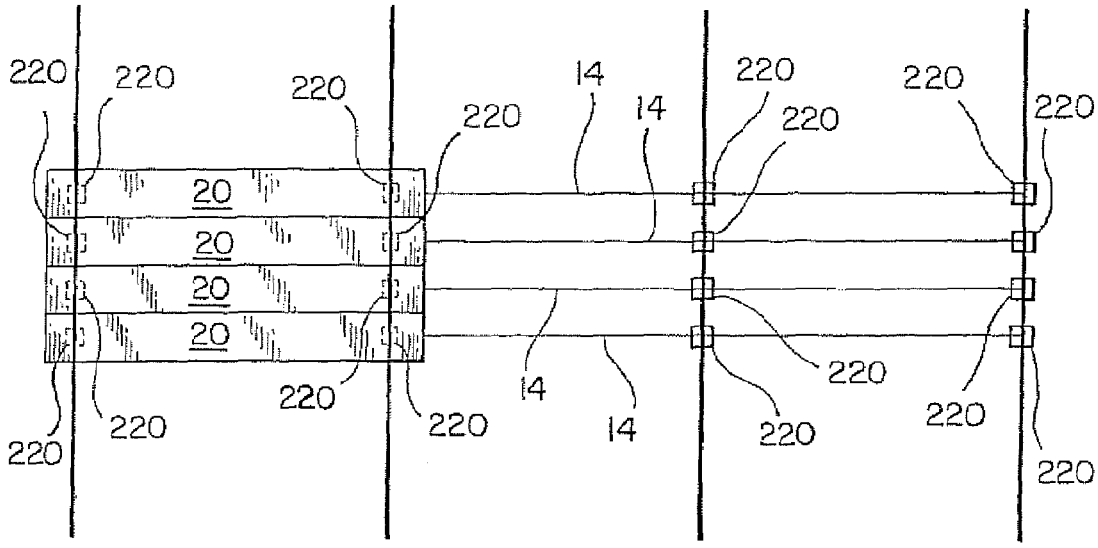

FIG. 12 is a schematic representation of a plurality of frames connected to a building.

Figure 13:
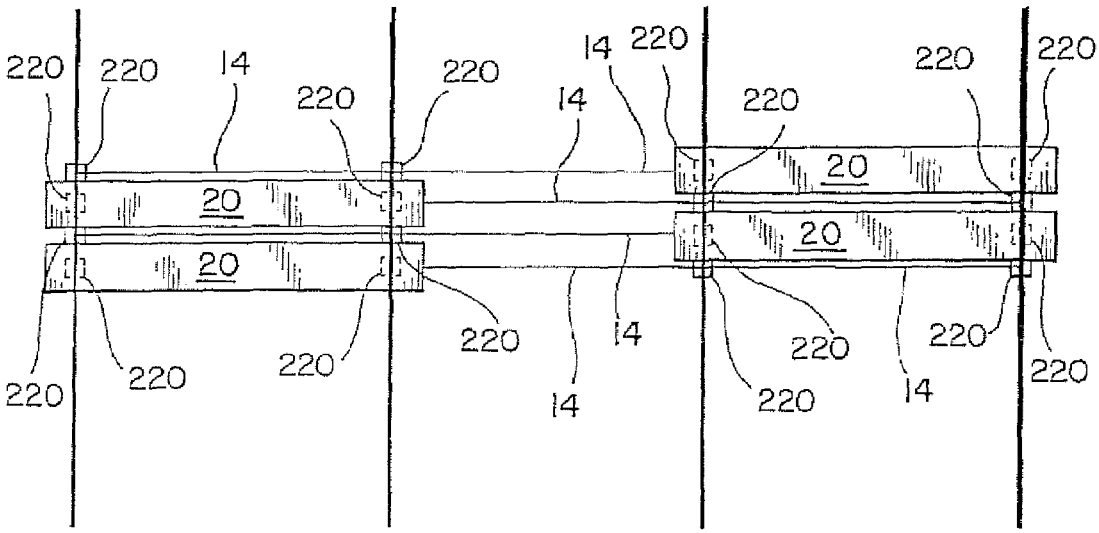

FIG. 13 is a schematic of an alternative arrangement of the frame relative to a building.

Figure 14:
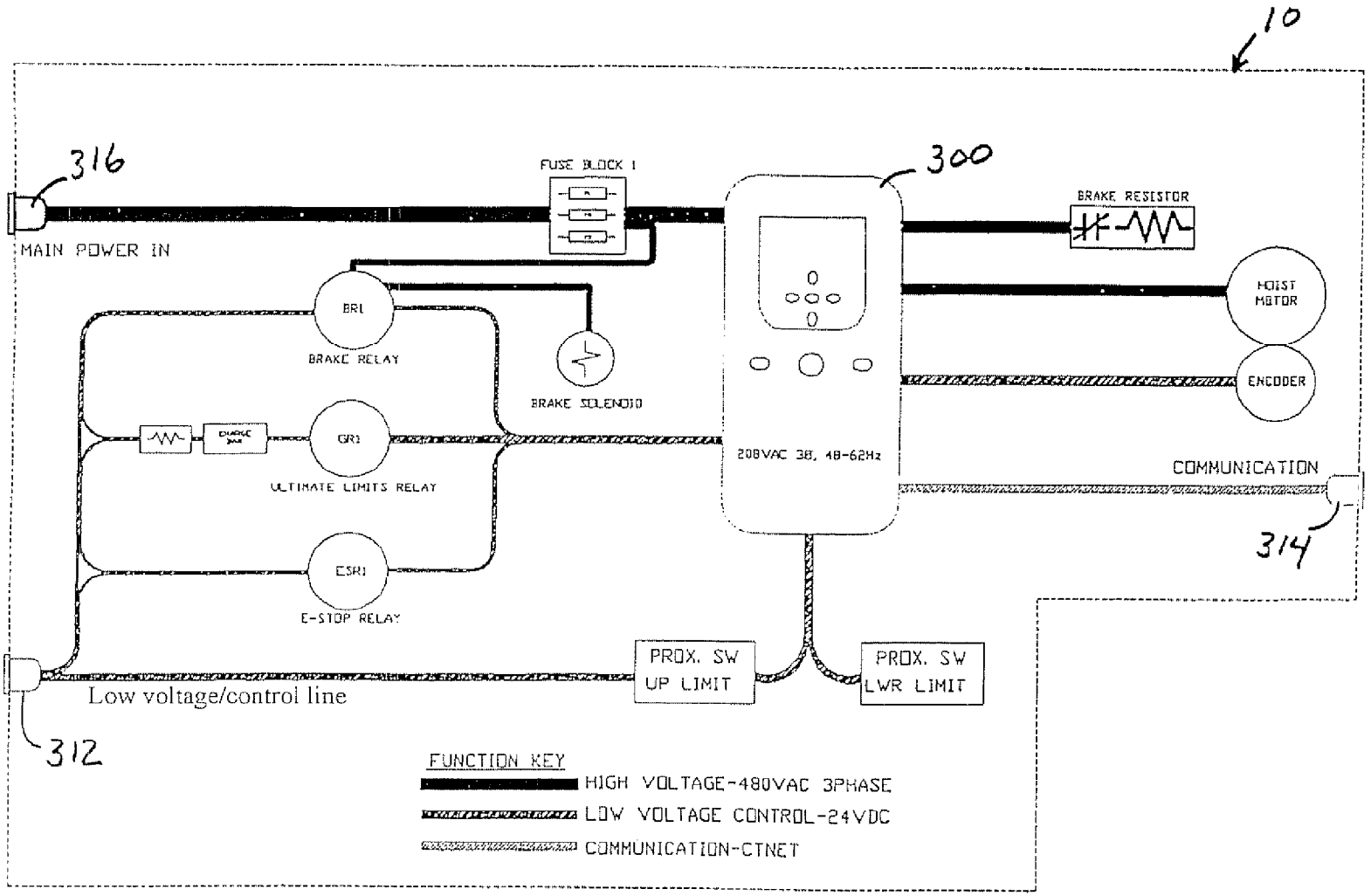

FIG. 14 is a schematic representation of control system components incorporated within the enclosed frame.

FIG. 15 is a schematic representation showing the available interconnection of a plurality of lift assemblies to a central control.

FIG. 16 is a partial cut away elevational view showing wire trays operably located with respect to a structural support and a lift assembly.

Figure 17:
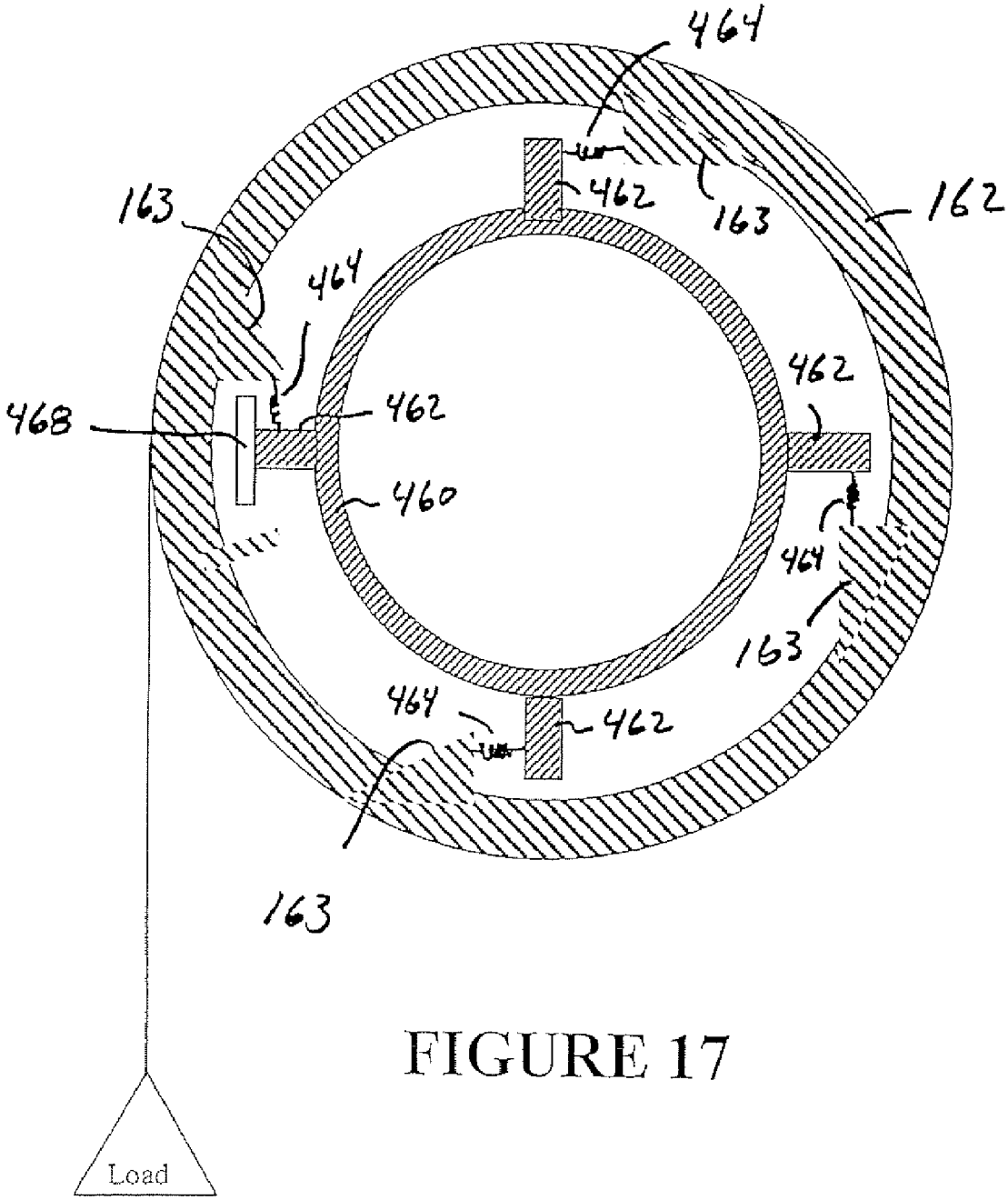

FIG. 17 is a cross sectional end view of a load-sensing drum.

Figure 18:
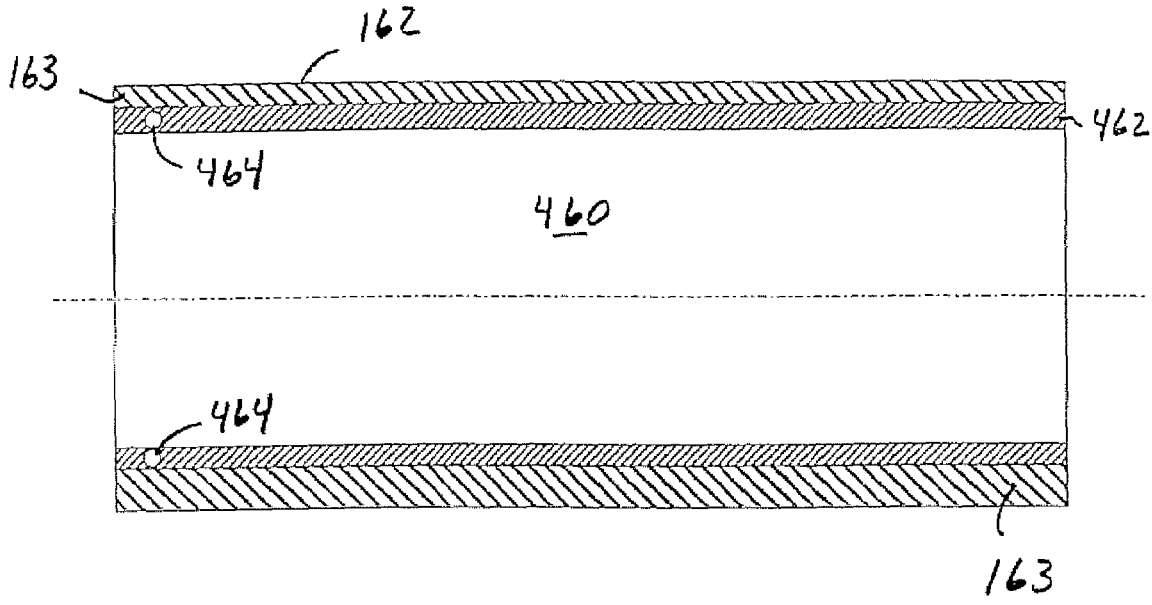

FIG. 18 is a cross sectional view taken along lines 18-18 of FIG. 17.

Figure 19:
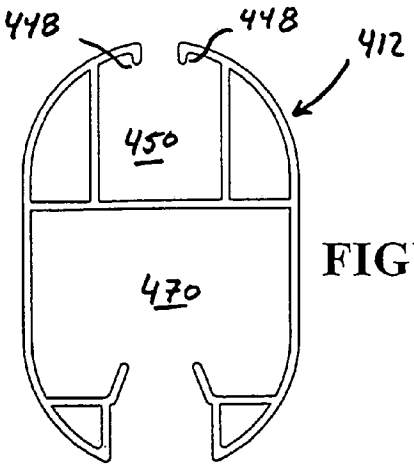

FIG. 19 is a cross sectional end view of a combination batten.

Figure 20:
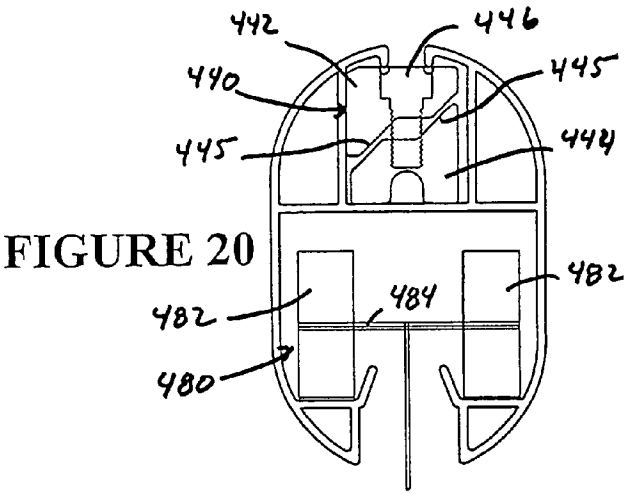

FIG. 20 is a cross sectional end view of the combination batten of FIG. 19 showing a carriage carried by the combination batten.

Figure 21:
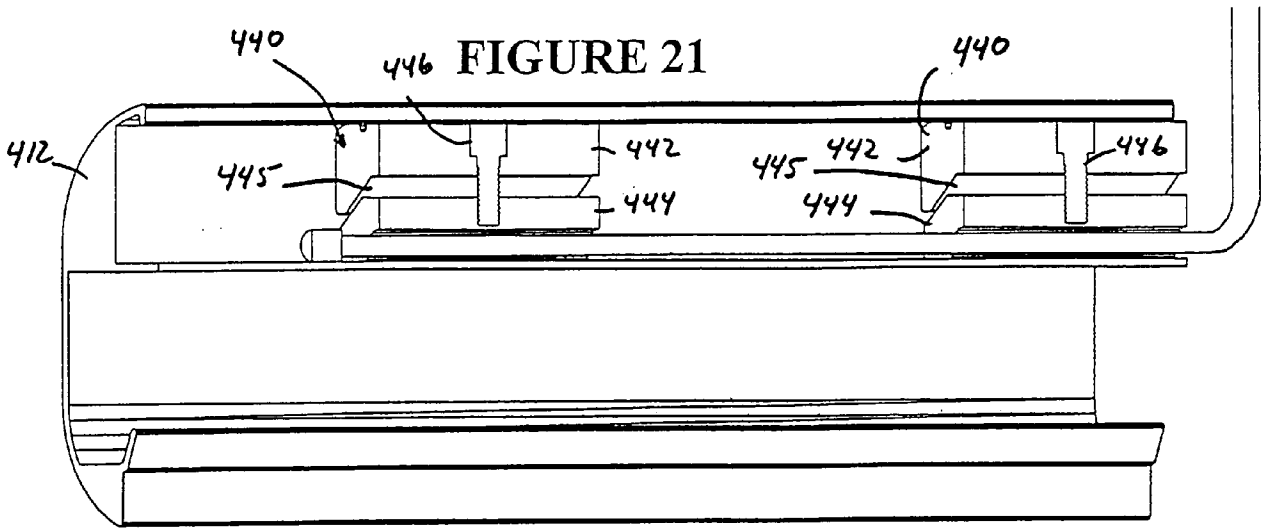

FIG. 21 is a perspective cross sectional view of the combination batten showing a pair of cable length adjusters.

Figure 22:
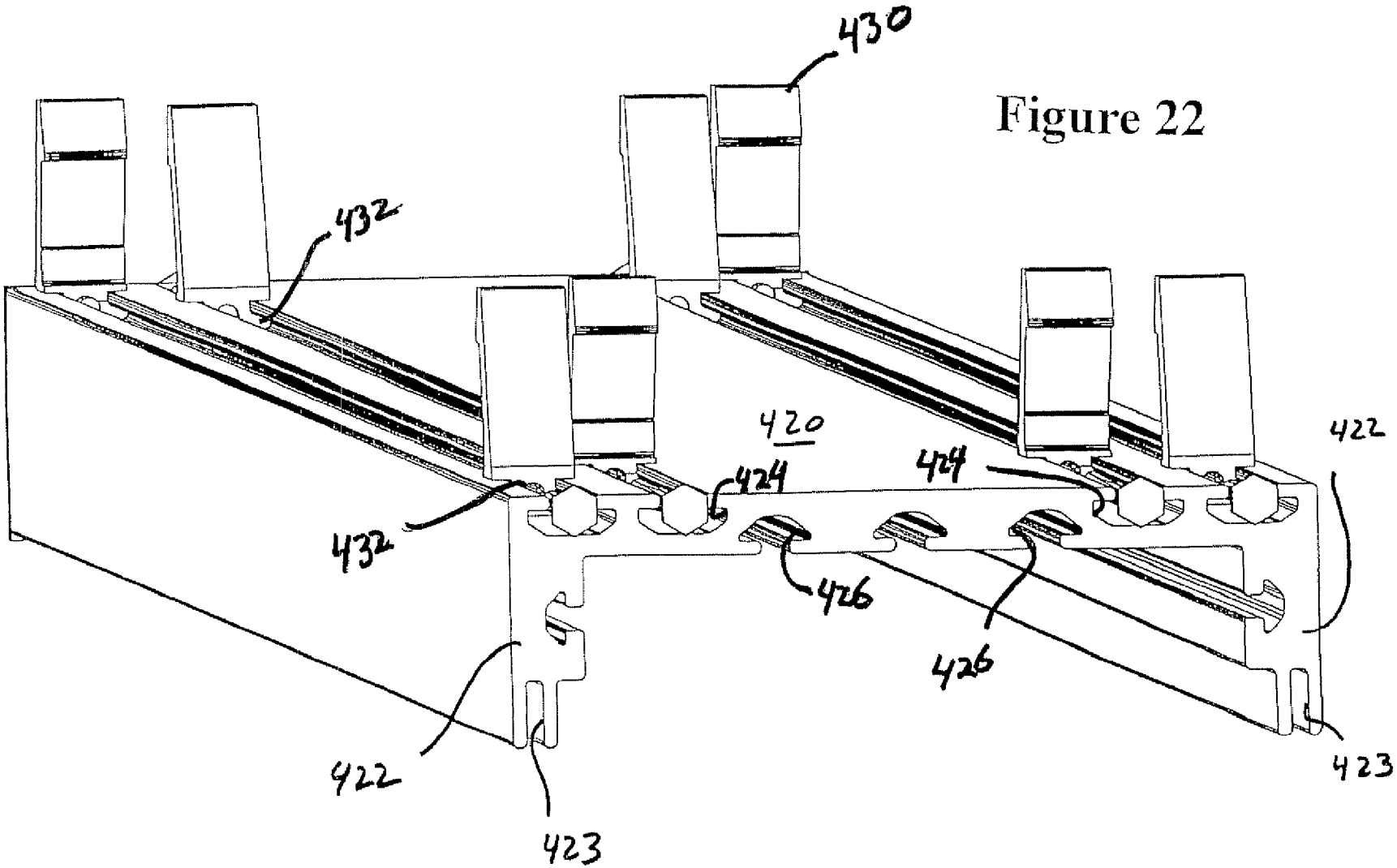

FIG. 22 is a perspective view of a backbone configuration for the frame.

Figures 23A, 23B:
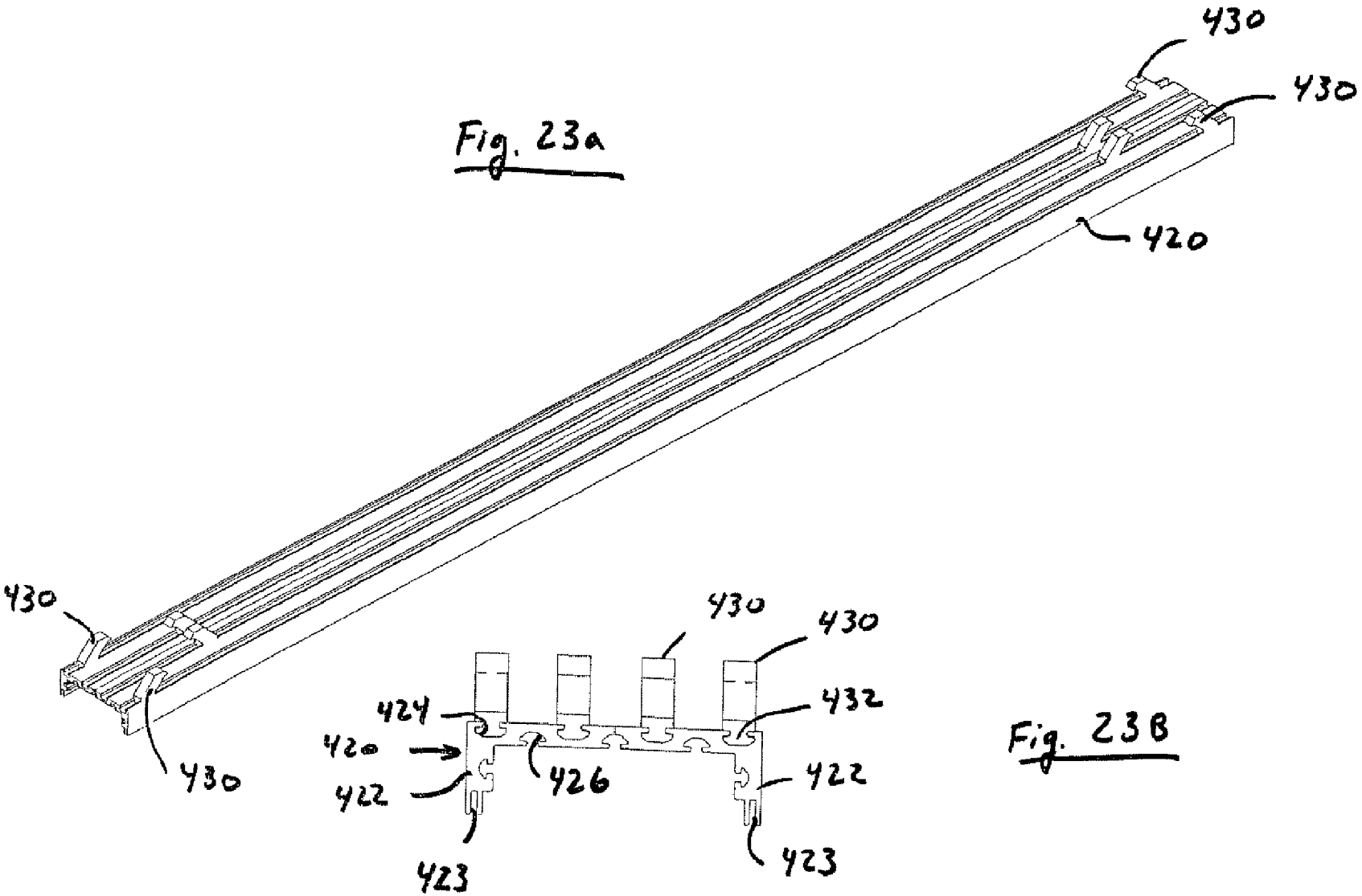

FIG. 23*a* is a perspective view of a backbone configuration for the frame employing an alternative clip assembly for engaging a structural support.

FIG. 23*b* is an end elevational view of the backbone of FIG. 23*a*.

Figure 24:
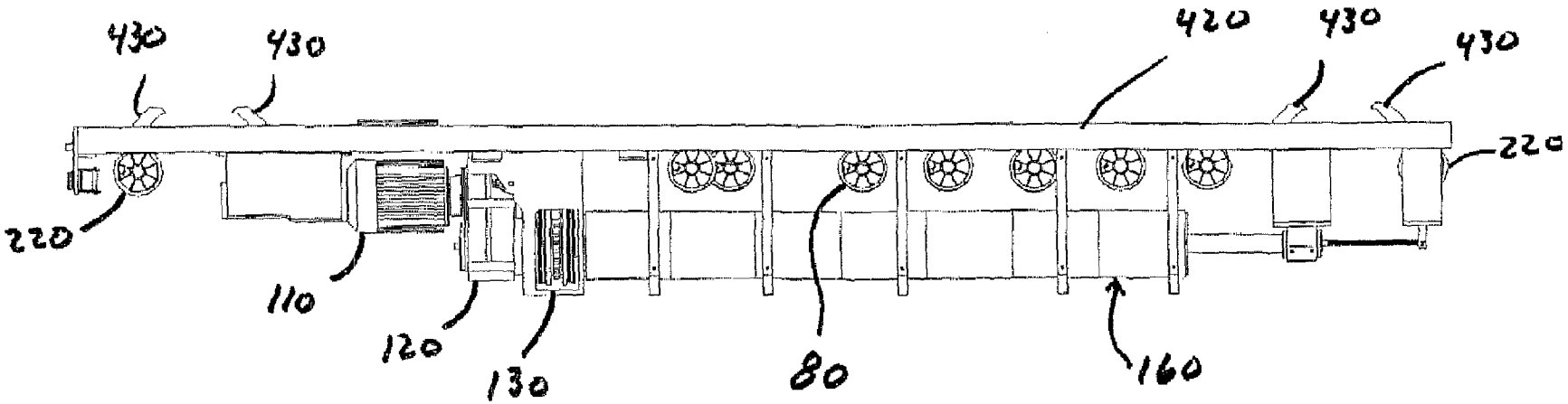

FIG. 24 is a side elevational view of a lift assembly without a housing.

Figure 25:
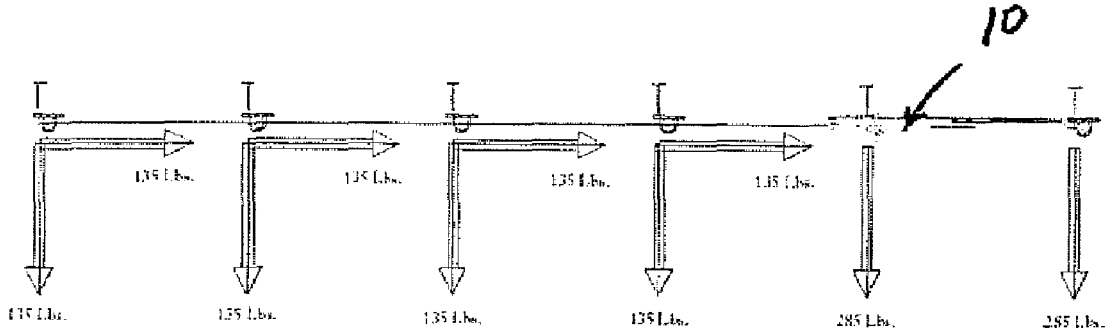

FIG. 25 is an elevational view showing a load distribution of a single installed lift assembly on structural supports.

Figure 26:
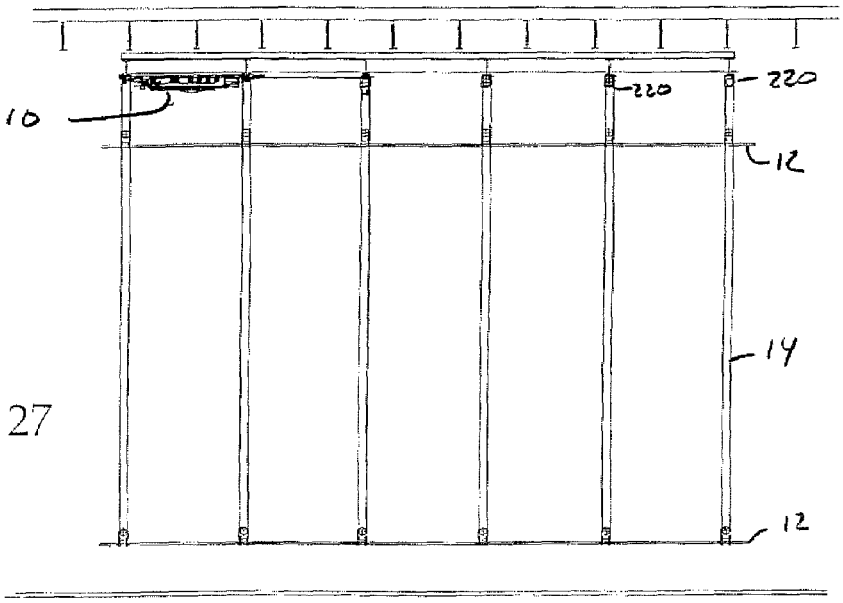

FIG. 26 is a side elevational view showing a double purchase rigging of the lift assembly.

Figure 27:
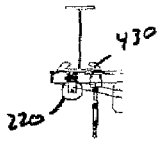

FIG. 27 is an enlarged side elevational view showing engagement of one end of the lift assembly with a structural support.

Figure 28:
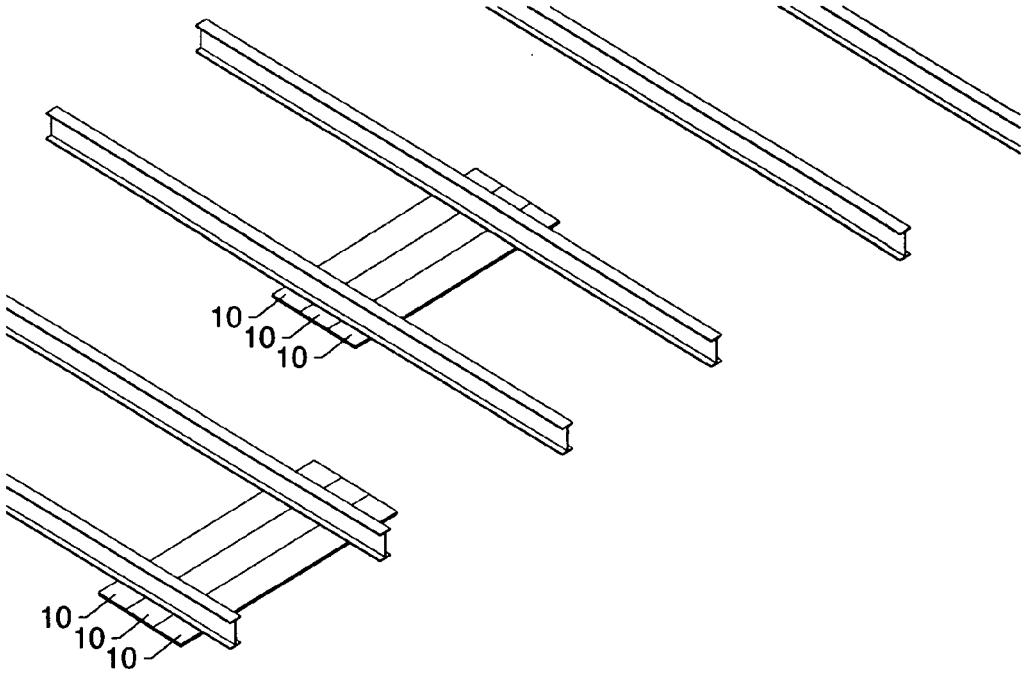

FIG. 28 is a partial perspective view showing a plurality of lift assemblies in an abutting installed relation on structural supports.

Figure 29:
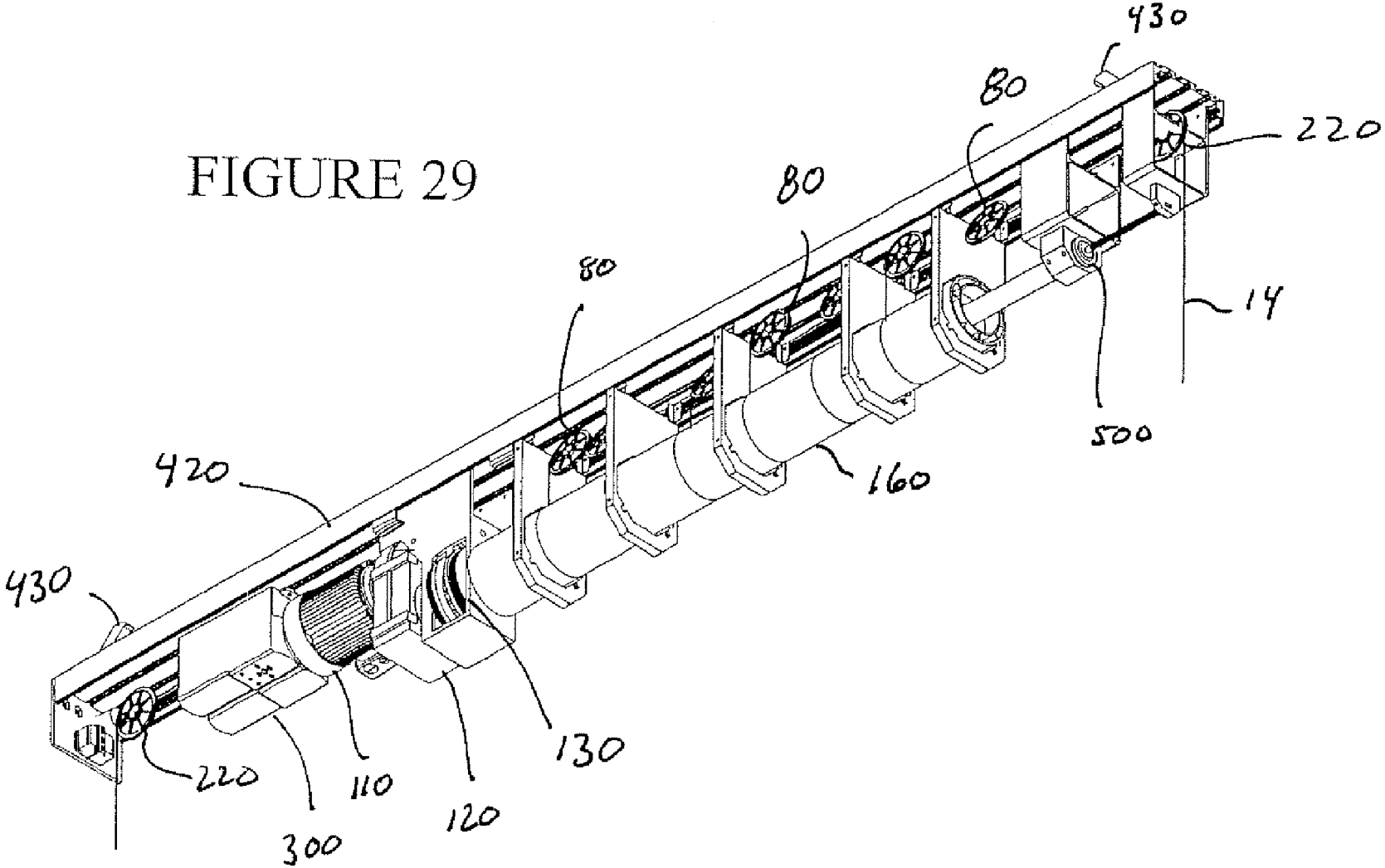

FIG. 29 is a lower perspective view of the lift assembly without a housing.

Figure 30:
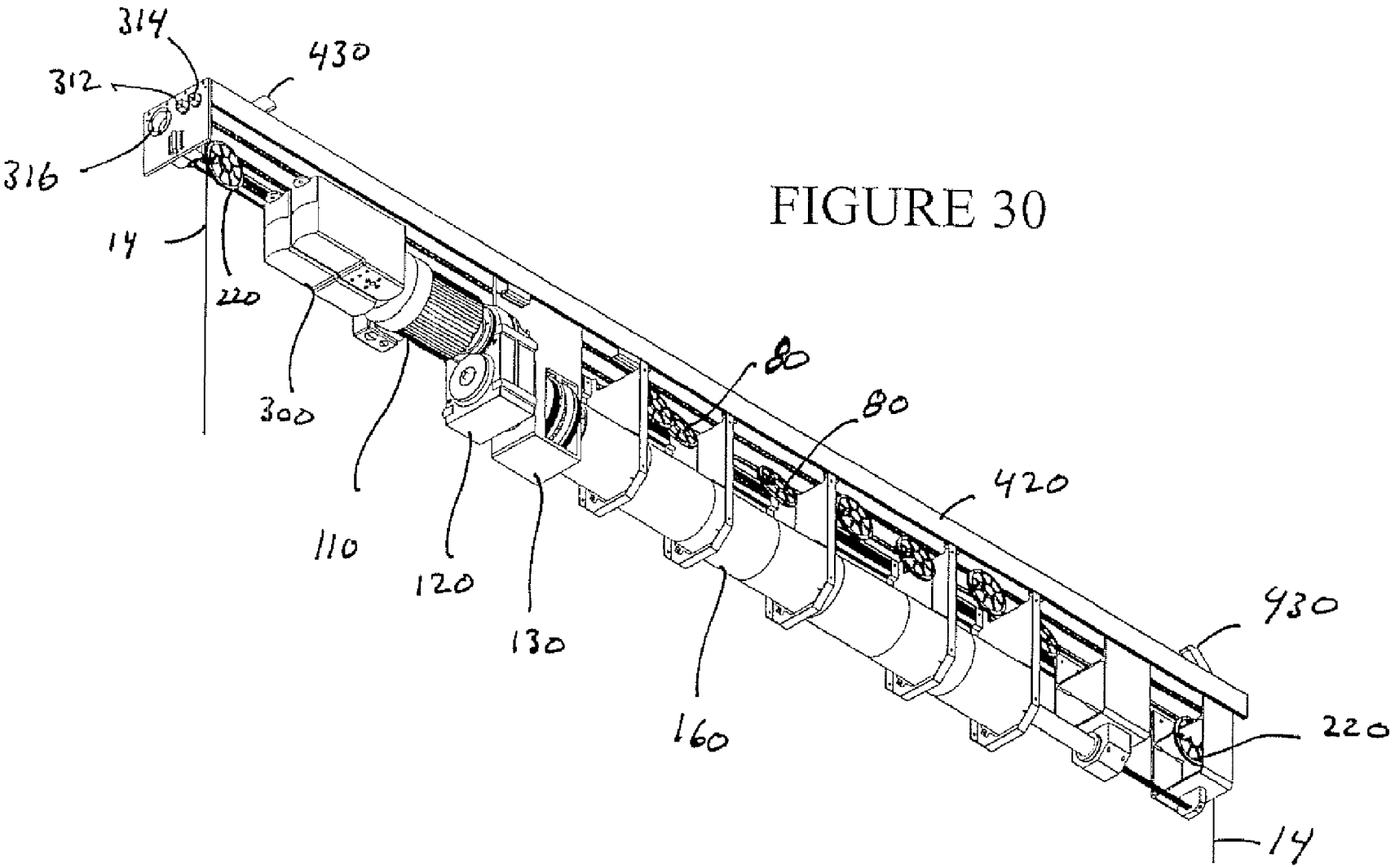

FIG. 30 is an alternative lower perspective view of a lift assembly without a housing.

Figure 31:
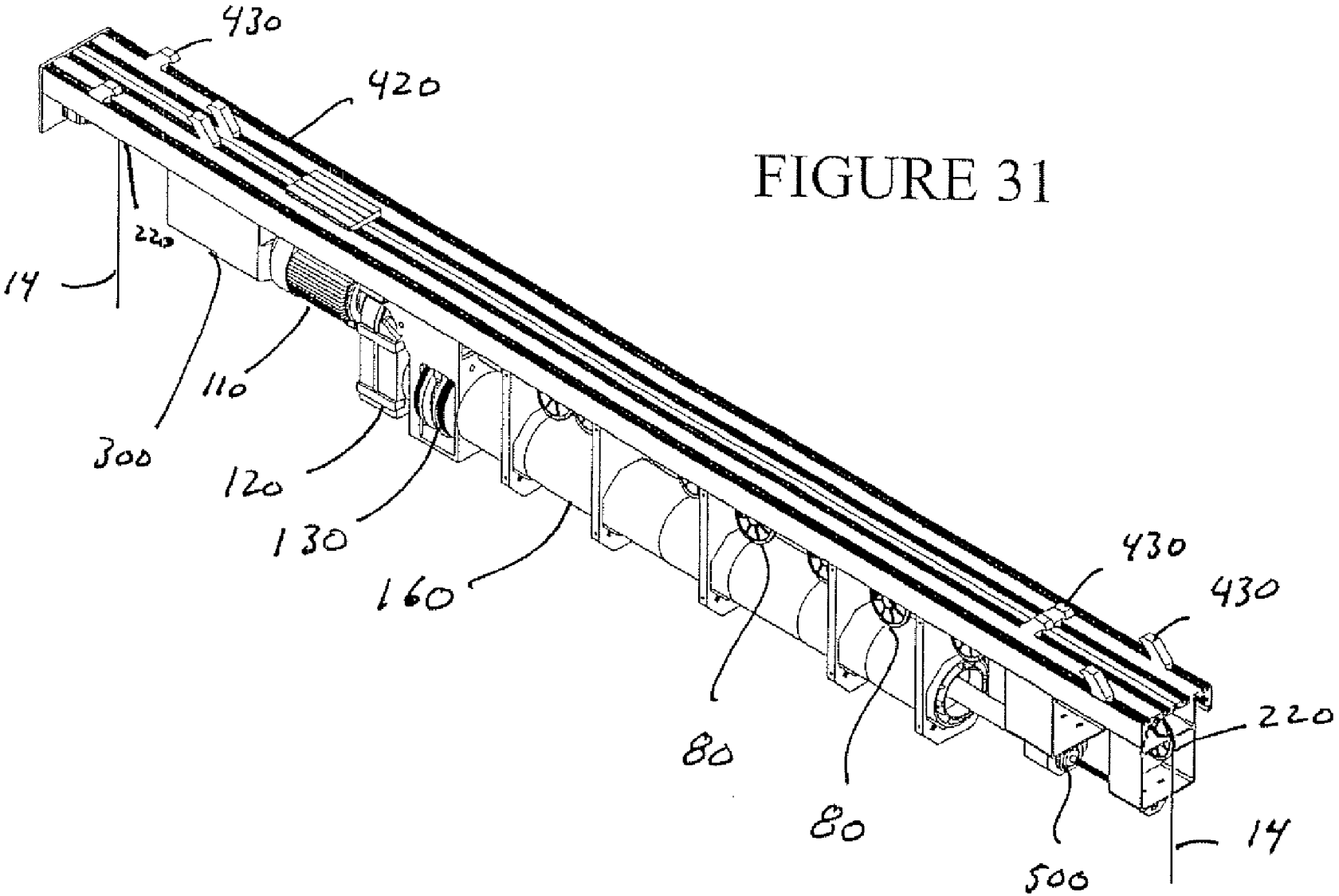

FIG. 31 is an upper perspective view of the lift assembly without a housing.

Figure 32:
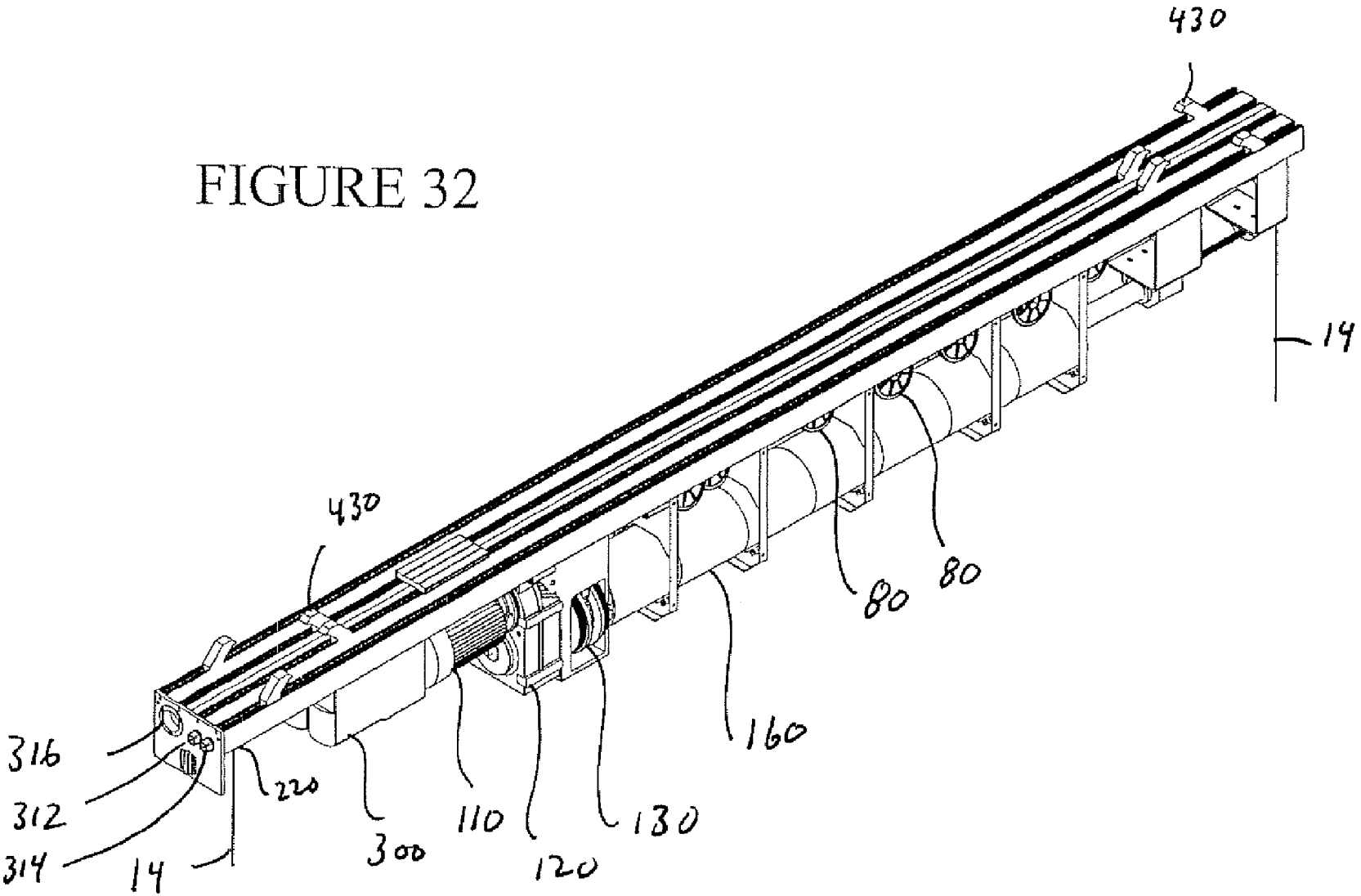

FIG. 32 is an alternative upper perspective view of the lift assembly without a housing.

Figure 33:
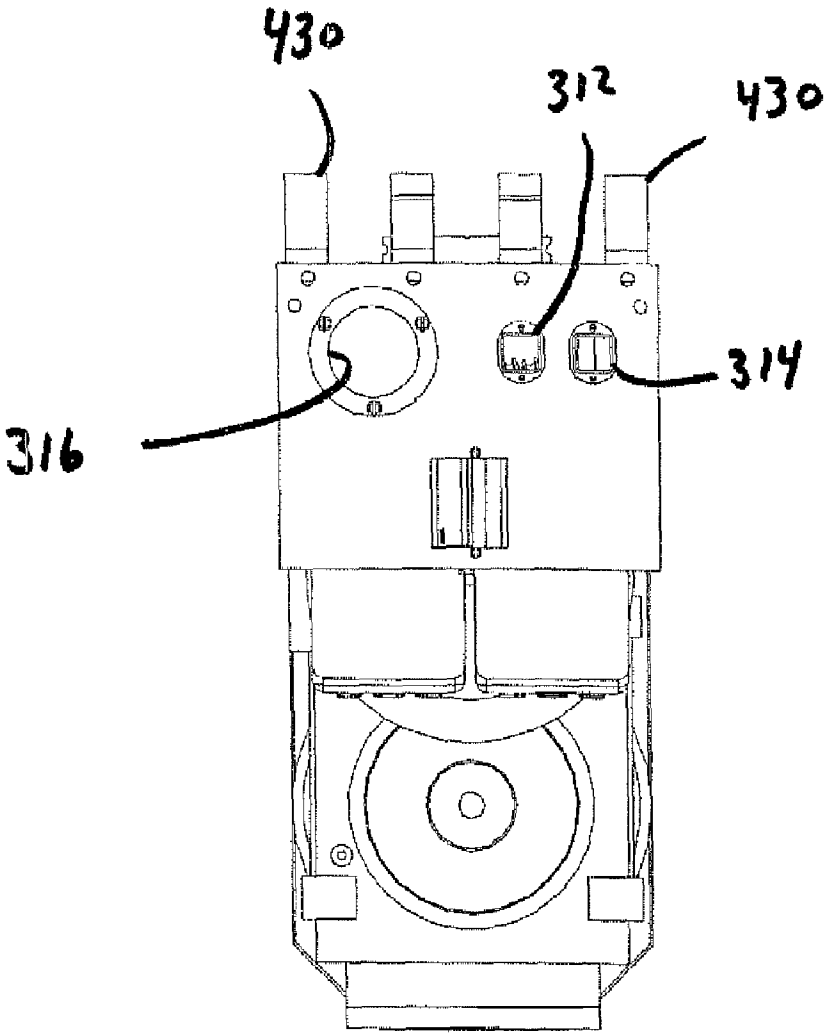

FIG. 33 is a left end elevational view of the lift assembly.

Figure 34:
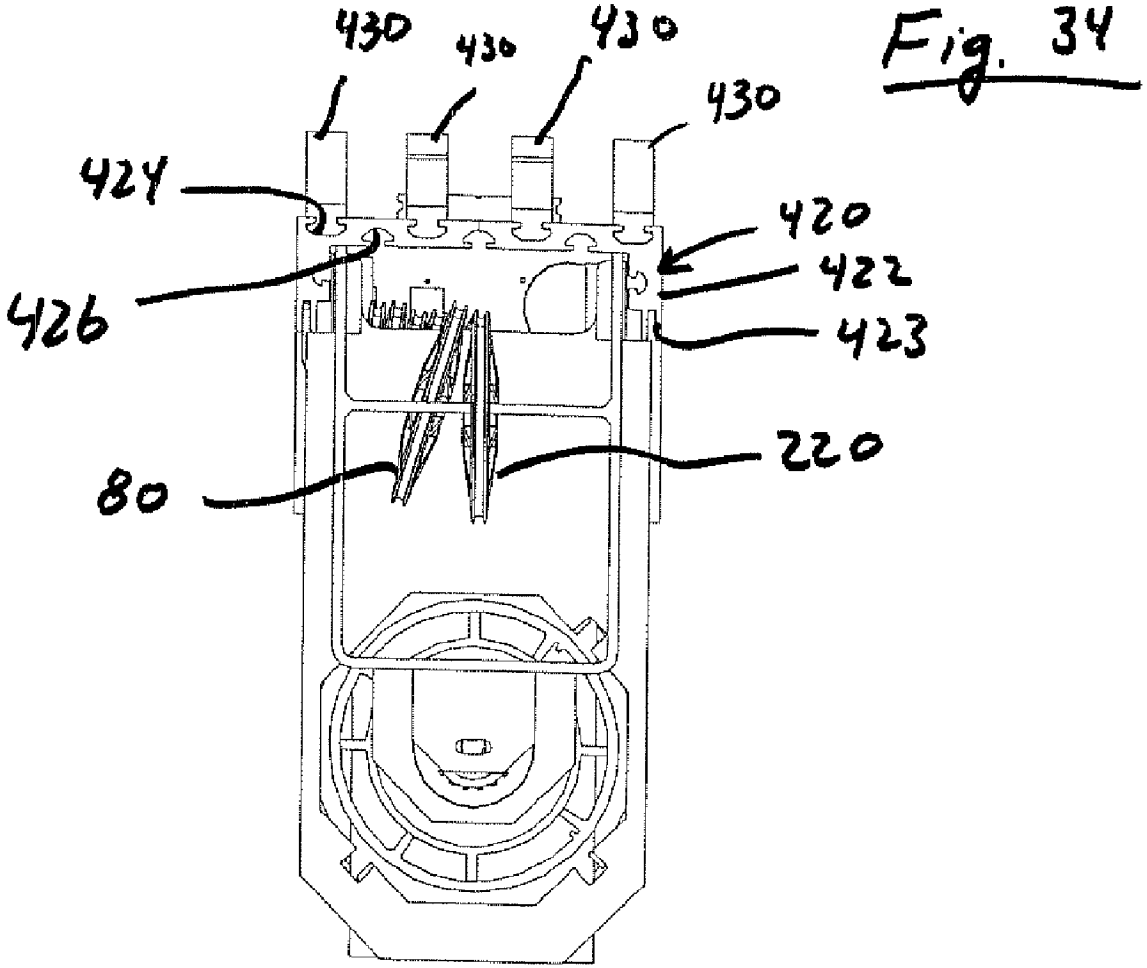

FIG. 34 is a right end elevational view of the lift assembly.

Figure 35:
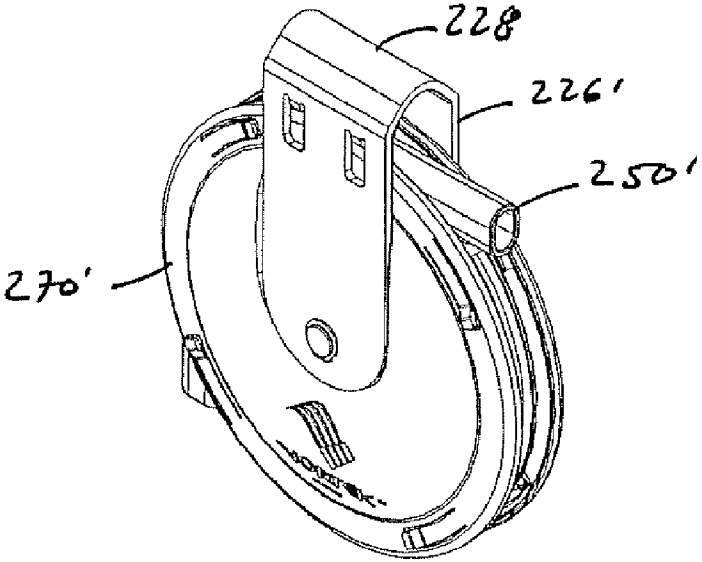

FIG. 35 is a perspective view of an external loft block for accommodating a single cable.

Figure 36:
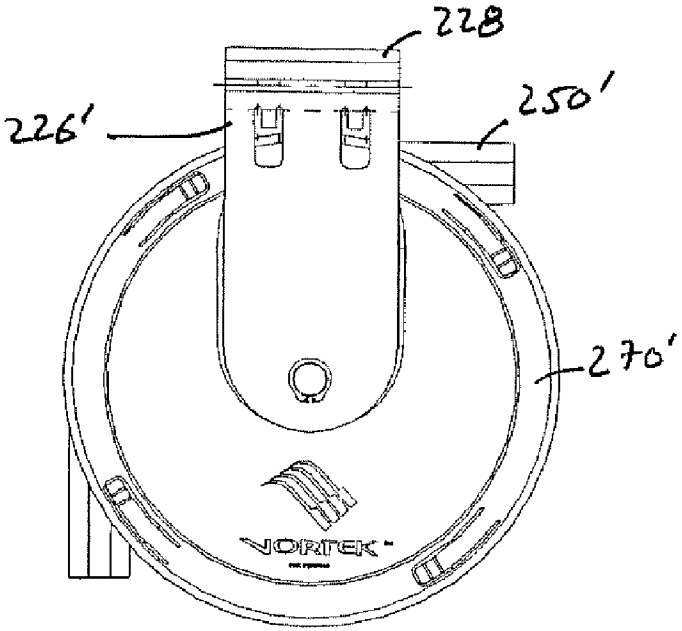

FIG. 36 is a side elevational view of the external loft block of FIG. 35.

Figure 37:
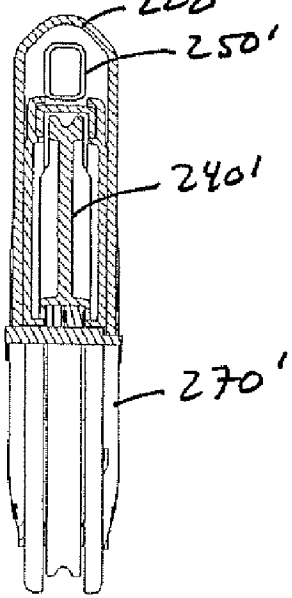

FIG. 37 is a partial cross sectional view of the external loft block of FIG. 35.

Figure 38:
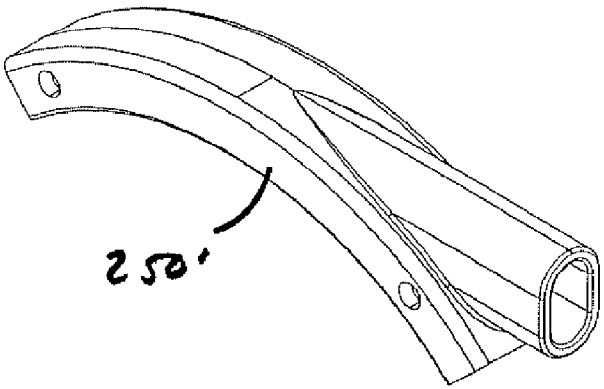

FIG. 38 is a perspective view of a single cable path guide.

Figure 39:
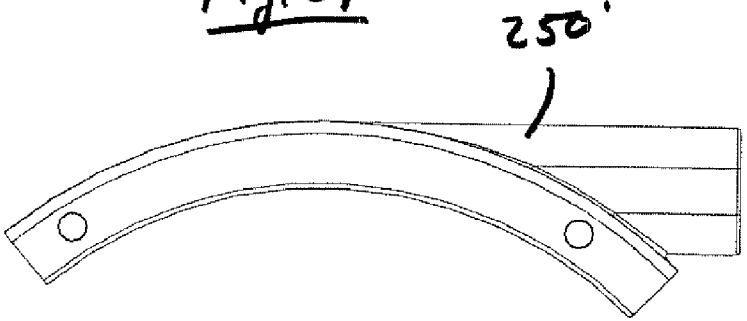

FIG. 39 is a side elevational view of the single cable path guide of FIG. 38.

Figure 40:
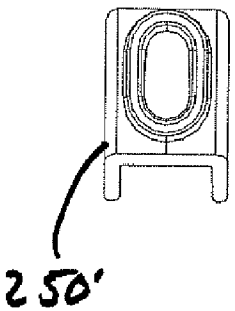

FIG. 40 is an end elevational view of the single cable path guide of FIG. 38.

Figure 41:
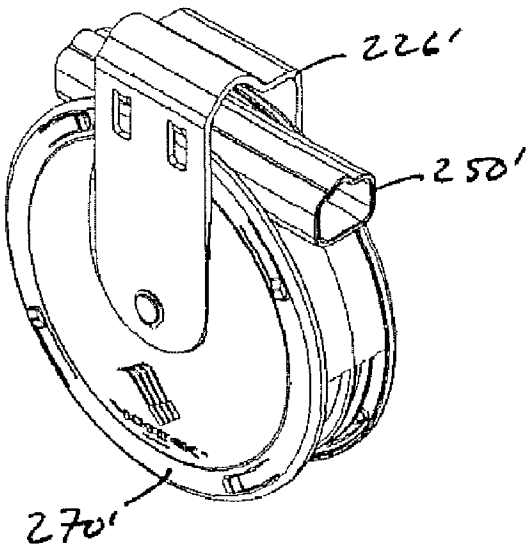

FIG. 41 is a perspective view of a multi cable external loft block.

Figure 42:
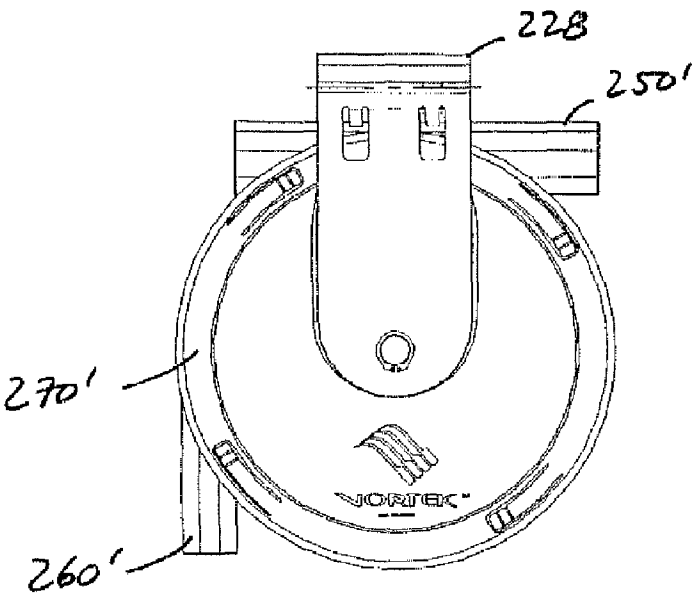

FIG. 42 is a side elevational view of the external loft block of FIG. 41.

Figure 43:
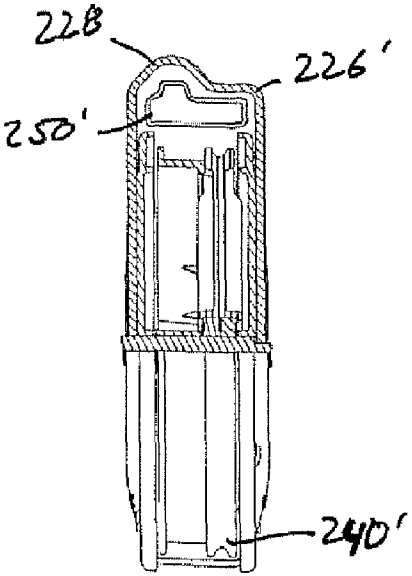

FIG. 43 is a partial cross sectional view of the external loft block of FIG. 41.

Figure 44:
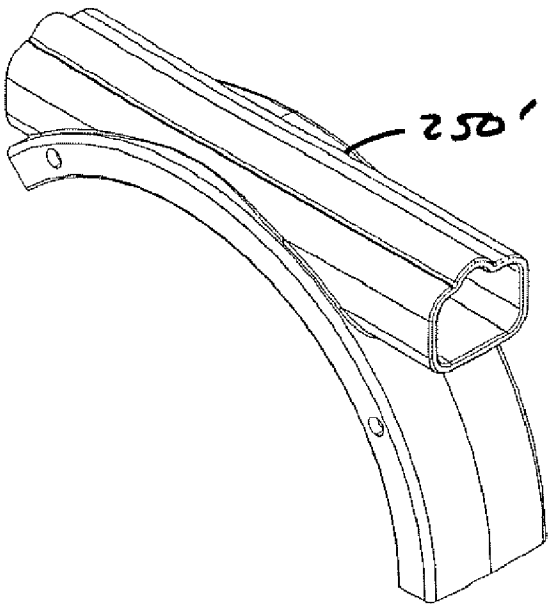

FIG. 44 is a perspective view of a multi cable path guide for the external loft block of FIG. 41.

Figure 45:
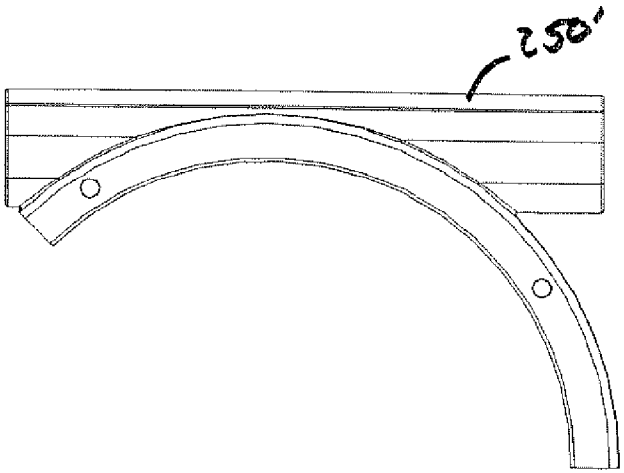

FIG. 45 is a side elevational view of the multi cable path guide of FIG. 44.

Figure 46:
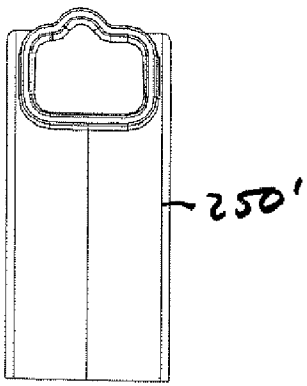

FIG. 46 is an end elevational view of the multi cable path guide of FIG. 44.

Figure 47:
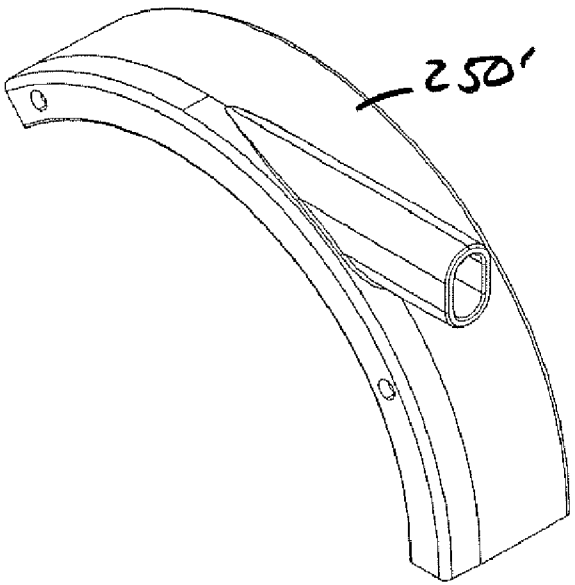

FIG. 47 is a perspective view of a single cable guide path for the external loft block of FIG. 41.

Figure 48:
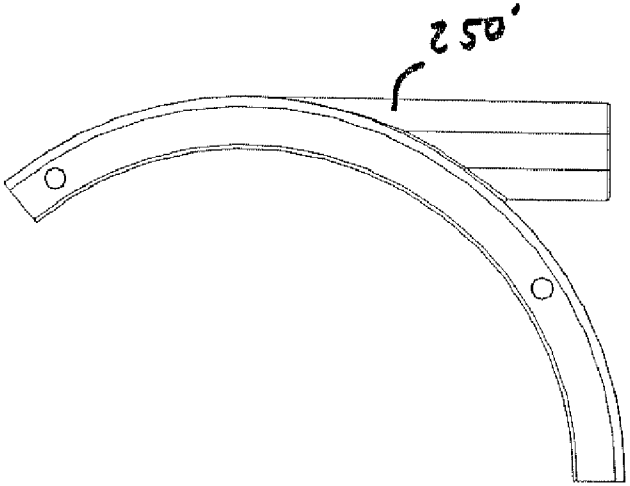

FIG. 48 is a side elevational view of the single cable guide path of FIG. 47.

Figure 49:
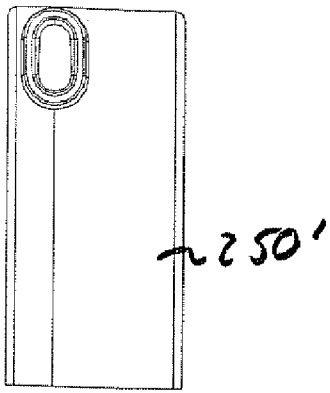

FIG. 49 is an end elevational view of the single cable guide path of FIG. 47.

Figure 50:
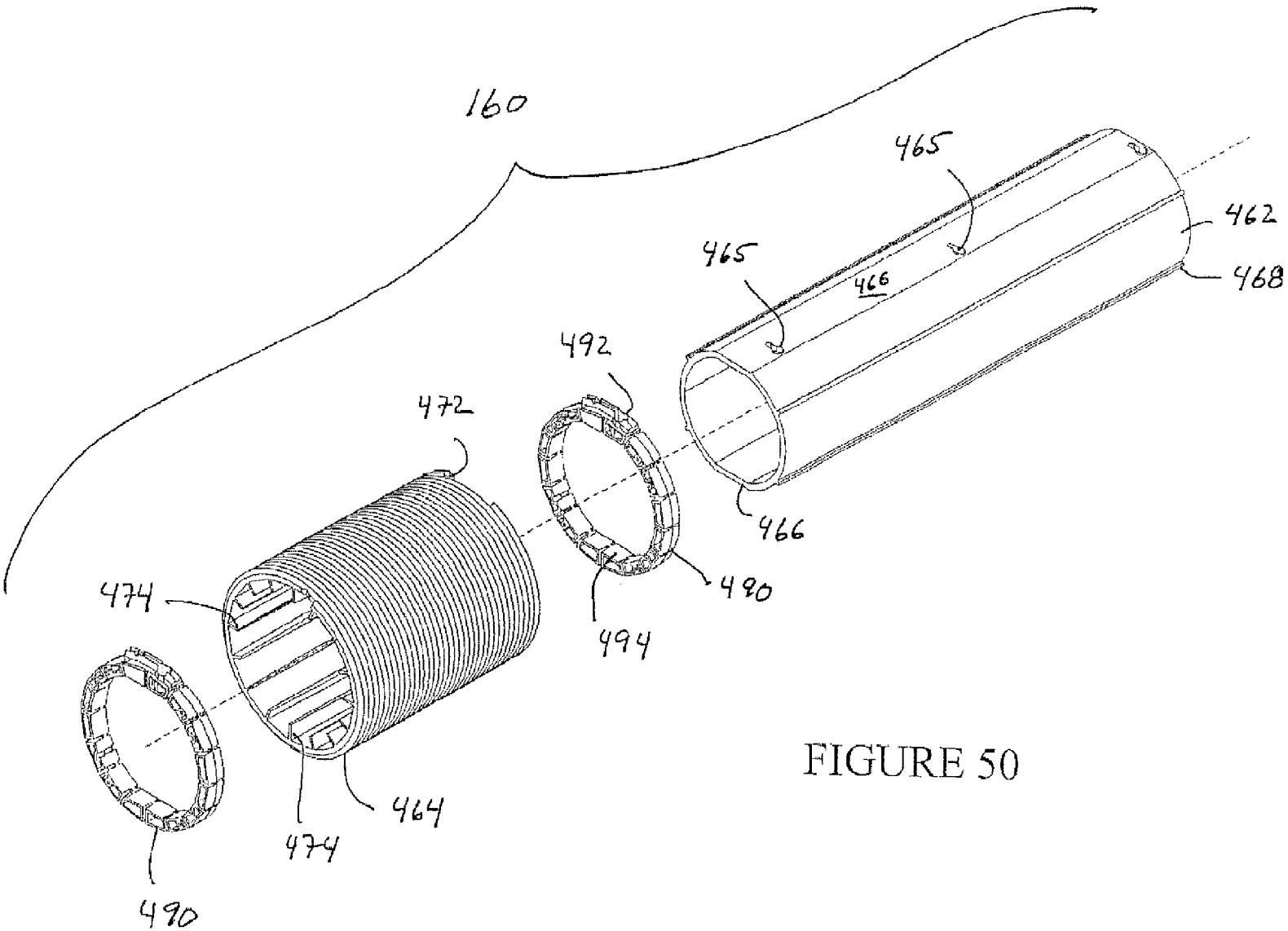

FIG. 50 is an exploded view of an alternative drum construction.

Figure 51:
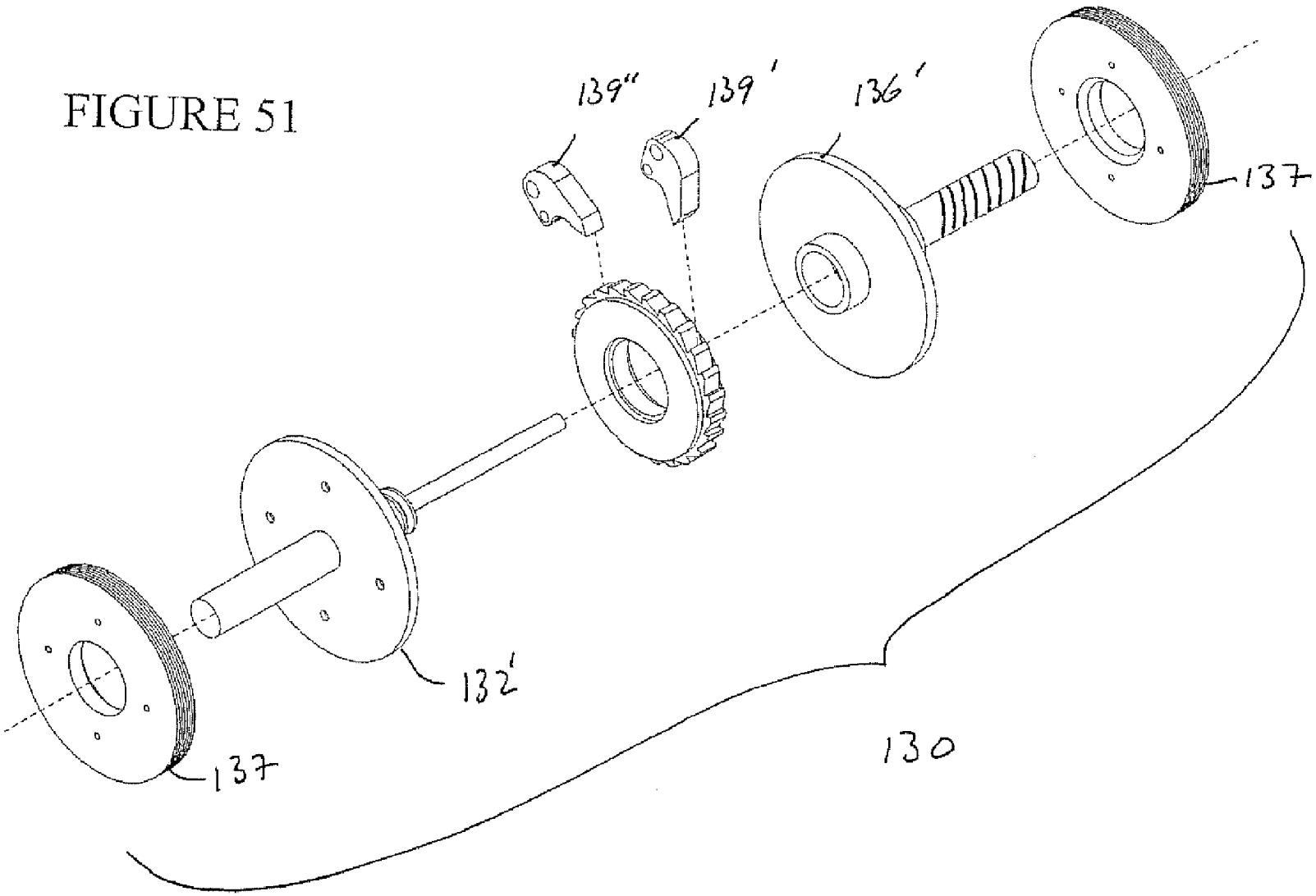

FIG. 51 is an exploded view of an alternative load brake.

Figure 52:
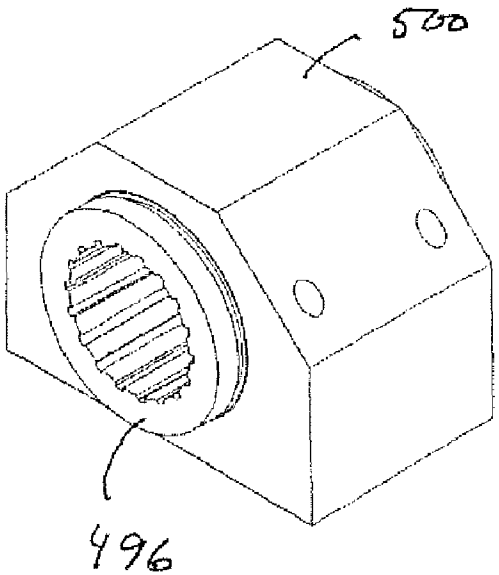

FIG. 52 is a perspective view of a linear bearing assembly for the lift assembly.

Figure 53:
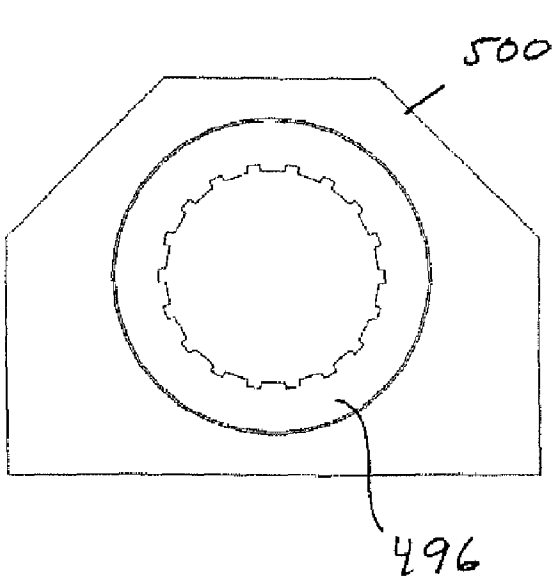

FIG. 53 is an end elevational view of the linear bearing assembly of FIG. 52.

Figure 54:
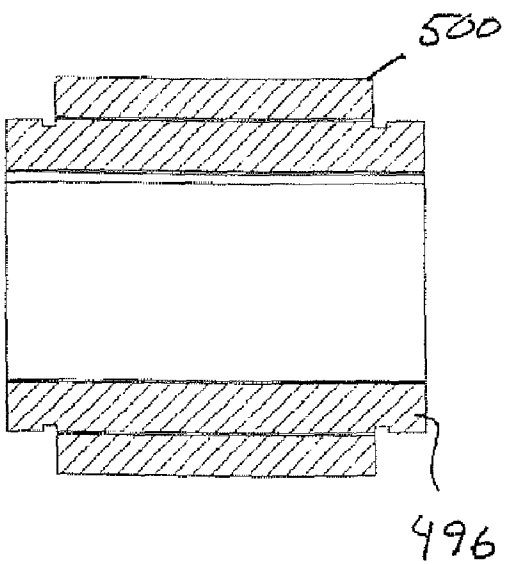

FIG. 54 is a cross sectional view of the linear bearing assembly of FIG. 52.

FIG. 55 is a perspective schematic of an overload/underload sensor.

FIG. 56 is a side elevational schematic view of an overload/underload sensor for an individual line.

Figure 57:
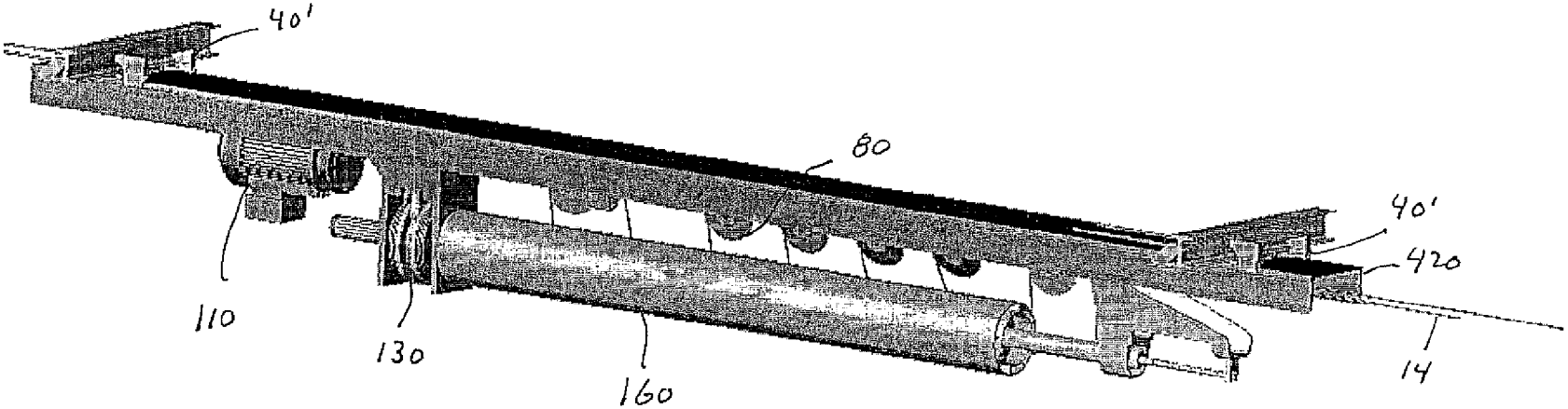

FIG. 57 is a perspective view of components of the hoist assembly, with the loft blocks omitted.

Figure 58:
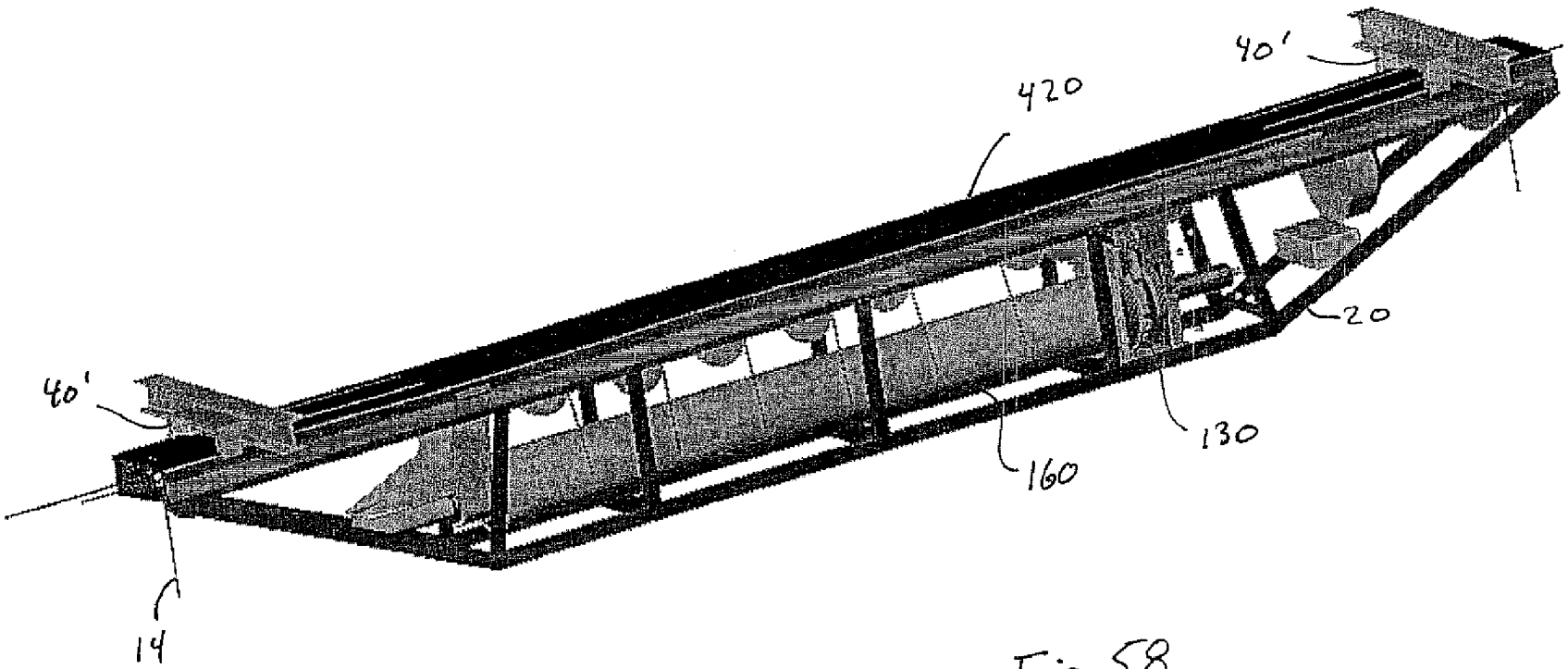

FIG. 58 is a perspective view of components of the hoist assembly including the frame, with the motor omitted.

Figure 59:
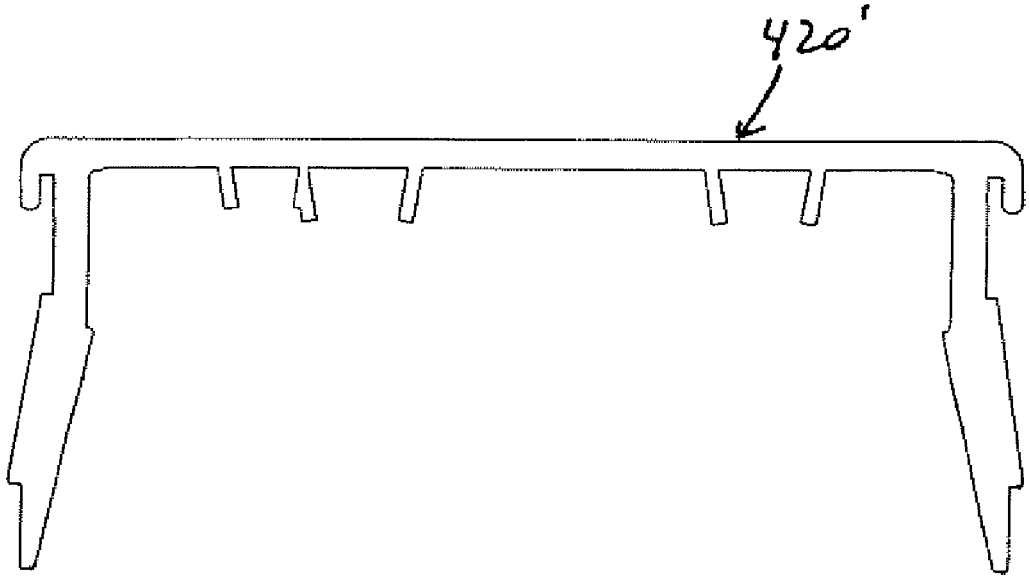

FIG. 59 is an end view of an alternative backbone configuration.

Figure 60:
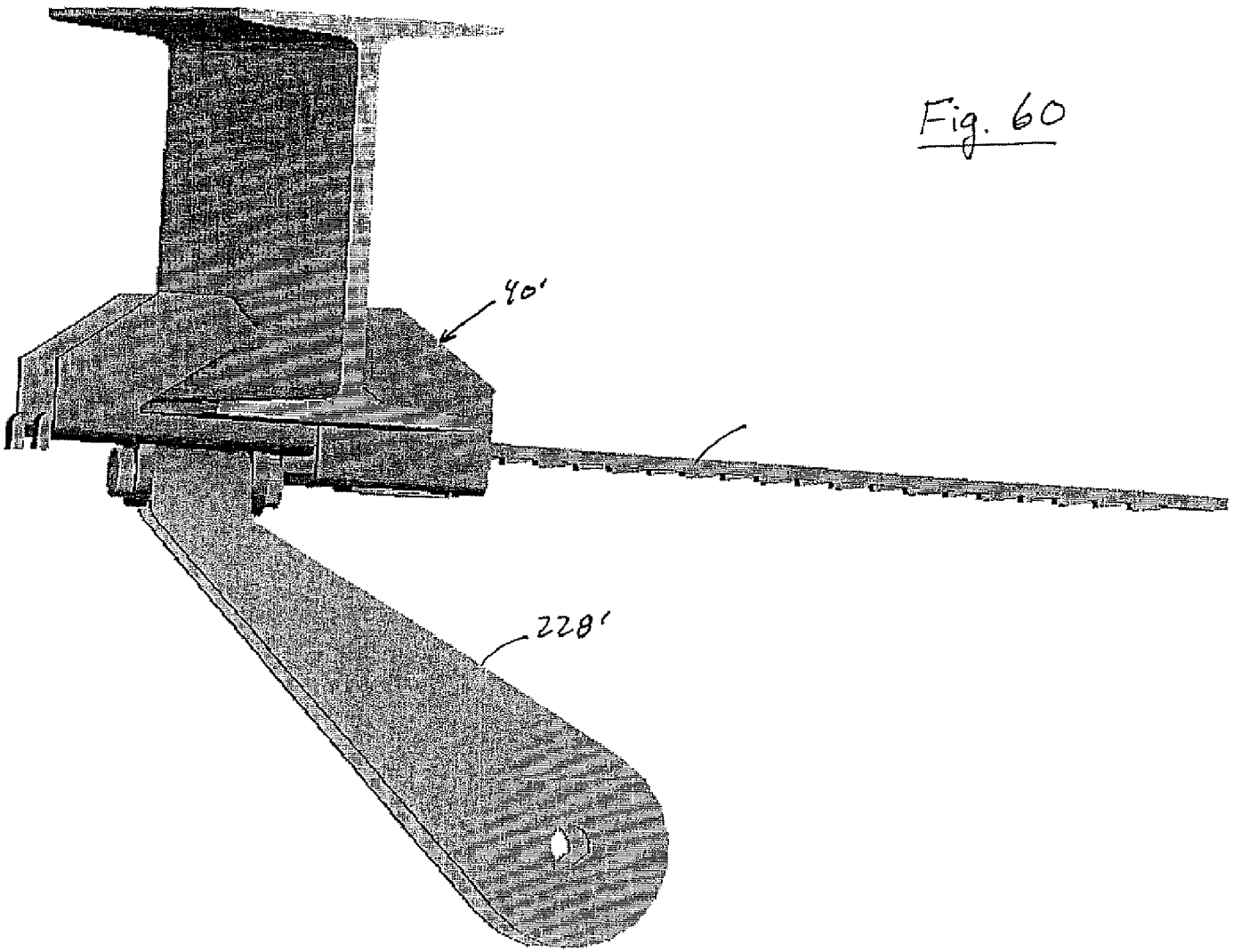

FIG. 60 is a perspective view of mounting assembly for attaching an external loft block to a structural beam.

Figure 61:
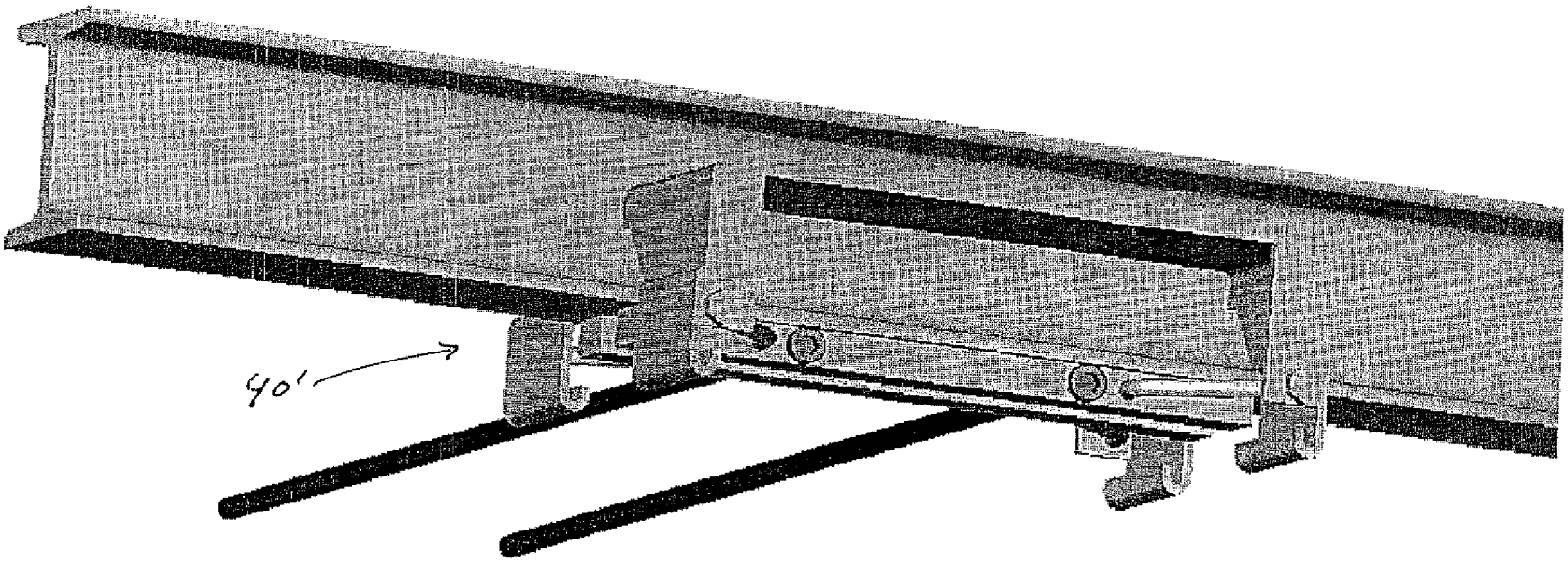

FIG. 61 is a perspective view of a clamp assembly of engaging the backbone or an external loft block to a structural beam.

DETAILED DESCRIPTION OF THE INVENTION

Figure 1:
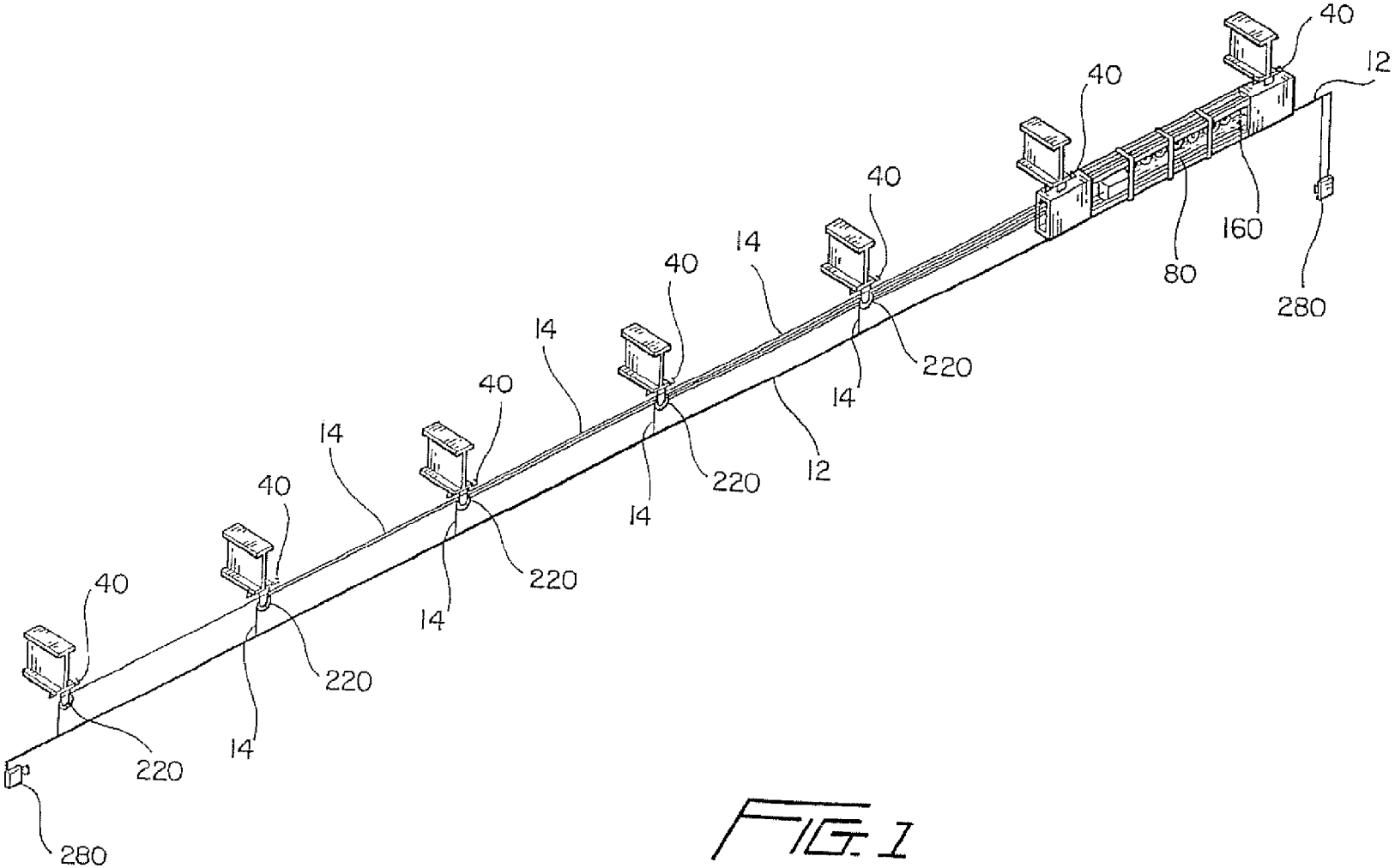
FIG. 1 is a perspective partial cutaway view of a building having a plurality of structural members to which the lift assembly is connected.

Referring to FIG. 1, the lift assembly 10 of the present invention is employed to selectively raise, lower and locate a batten 12 relative to a building or surrounding structure. Preferably, the lift assembly 10 moves a connected batten 12 between a lowered position and a raised position.

Although the term "batten" is used in connection with theatrical and staging environment, including scenery, staging, lighting as well as sound equipment, it is understood the term encompasses any load connectable to a windable cable.

The term "cable" is used herein to encompass any wire, metal, cable, rope, wire rope or any other generally inelastic windable material.

The term "building" is used to encompass a structure or facility to which the lift assembly is connected, such as but not limited to, performance venues, theaters, arenas, concert halls, auditoriums, schools, clubs, educational institutions, stages, convention centers, television studios showrooms and places of religious gathering. Building is also understood to encompass cruise ships which may employ battens.

Figure 2:
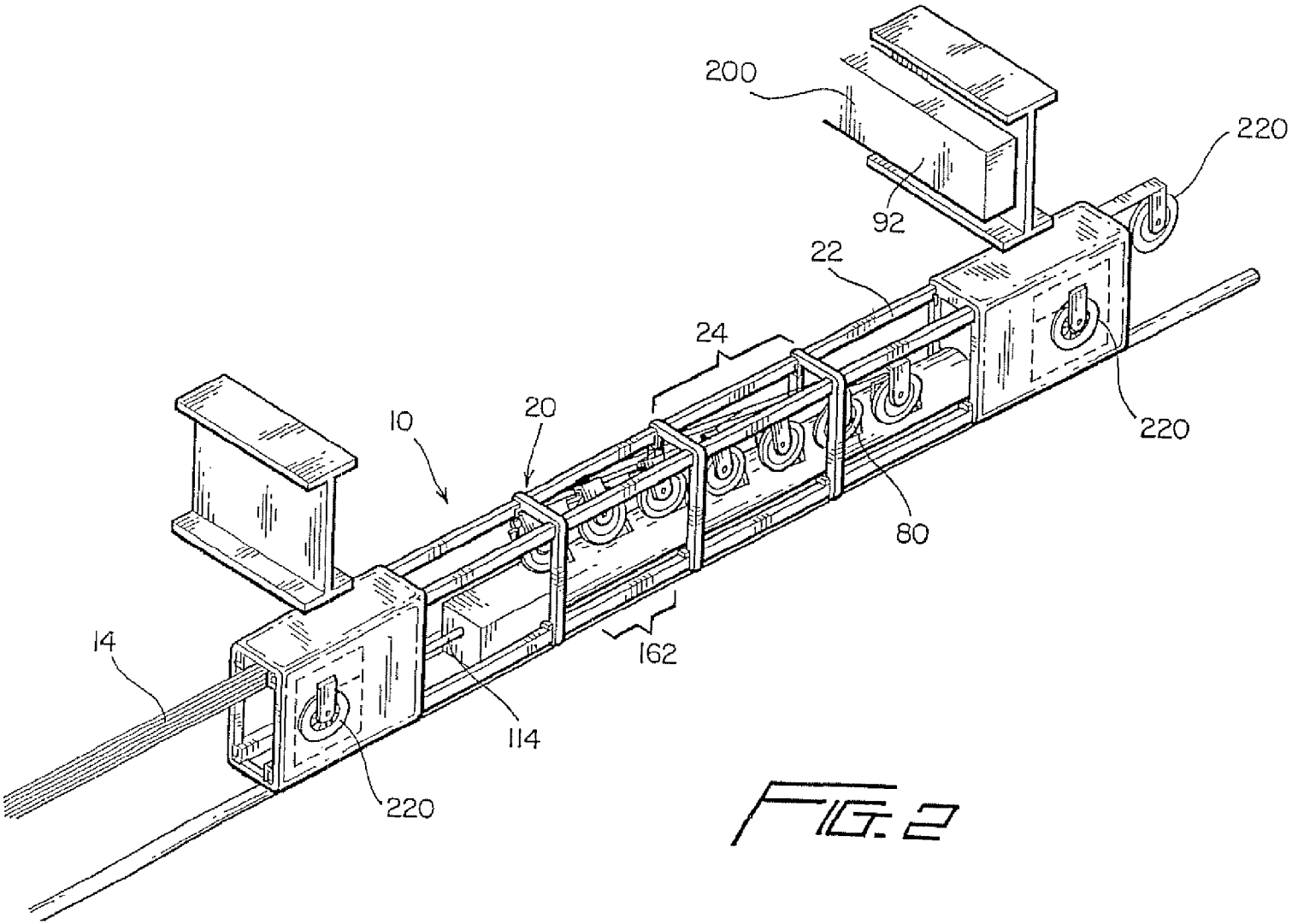
FIG. 2 is an enlarged perspective partial cutaway view of the installed lift assembly.
Figure 3:
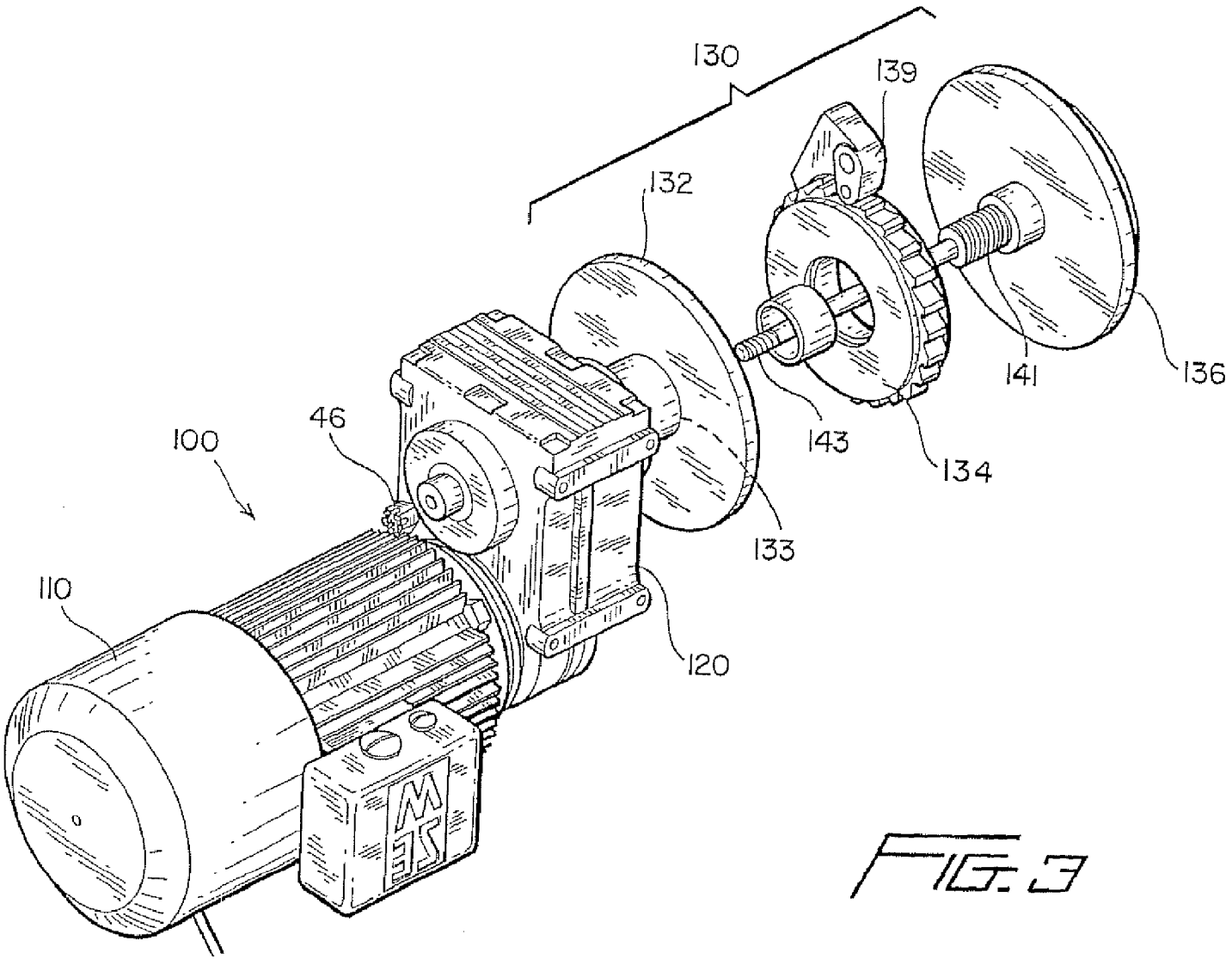
FIG. 3 is an exploded perspective view of a drive mechanism for the lift assembly.

Referring to FIGS. 1, 2 and 3, the lift assembly 10 includes a frame, at least one head block 80, a drive mechanism 100, a rotatable drum 160 and a corresponding loft block 220.

The lift assembly 10 is constructed to cooperate with at least one cable 14. Typically, the number of cables is at least four, but may be as many as eight or more. As shown in the Figures, a cable path extends from the drum 160 through a corresponding head block 80 to pass about a loft block 220 and terminate at the batten 12.

Frame

As shown in FIGS. 1 and 2, the frame 20 is a rigid skeleton to which the drum 160, the drive mechanism 100 and the head block 80 are attached. In a preferred configuration, the frame 20 is sized to enclose the drive mechanism 100, the drum 160, a head block 80 and at least one internal loft block 220. However, it is understood the frame 20 can form a backbone 420 to which the components are connected as seen in FIGS. 24 and 29-32.

The frame 20 may be in the form of a grid or a box. The frame 20 can be formed of angle irons, rods, bars, tubing or other structural members. Typically, the frame 20 includes interconnected runners, struts and crossbars 22. The runners, struts and crossbars may be connected by welding, brazing, rivets, bolts or releasable fasteners. The particular configuration of the frame 20 is at least partially dictated by the intended operating environment and anticipated loading. To reduce the weight of the frame 20, a relatively lightweight and strong material such as aluminum is preferred. However, other materials including but not limited to metals, alloys, composites and plastics can be used in response to design parameters. Although the frame 20 is shown in skeleton configuration, it is understood the frame may be enclosed as a box or enclosure 210 having walls to define and enclose an interior space.

In one configuration, the frame 20 is formed from a plurality of modular sections 24, wherein the sections may be readily interconnected to provide a frame of a desired length. Thus, the frame 20 may accommodate a variety of cables and hence drum lengths.

The frame 20 is constructed to be connectable to the building. The frame 20 can include a fixed coupler and a sliding coupler, wherein the distance between the fixed coupler and the sliding coupler can be varied to accommodate a variety of building spans. Typically connections of the frame 20 to the building include clamps, fasteners, bolts and ties. These connectors may be incorporated into the frame, or are separate components attached during installation of the frame. As set forth herein, adjustable clip assemblies 40 are provided for retaining the frame relative to the building.

In a further configuration, the frame 20 incorporates the rigid elongate backbone 420 to which the drive mechanism 100 and the drum supports as well as the head blocks 80 and the internal loft blocks 220 are connected. The use of a single, generally monolithic backbone 420 reduces the complexity of locating the various components within the frame 20.

The backbone 420, or frame, cooperates with the enclosure 210 to define an encompassing housing for the drum, the drive mechanism, the load brake as well as local controller. The housing 210 is preferably relatively lightweight material such as fiberglass or composite and can include a sound deadening lining to absorb noise generation from the internal components.

Further, the housing 210 reduces exposure of the enclosed lift assembly 10 from environmental influence as well as reducing risk of unintended contact with various moving portions of the lift assembly.

The enclosure 210 typically includes apertures vertically exposed to the stage through which lift lines pass from any internal loft blocks 220. In addition, at least one end of the housing 210 includes apertures through which the lift lines extend from corresponding head blocks 80 within the frame 20 (housing 210) to pass to the external loft blocks 220.

Thus, as shown in FIGS. 12,13 and 28, a plurality of lift assemblies 10 can be in an abutting or substantially adjacent orientation thereby permitting a greater density of load carrying mechanisms within a given depth of a stage. That is, a plurality of lift assemblies 10 can be oriented in a parallel orientation, with minimal spacing between adjacent units. The present lift assemblies allow mounting of the assemblies on 12" centers, wherein the components can be sized to provide even further reduced spacing, such as 9" centers. However, the lift assembly 10 can be constructed to have a width of approximately 11 inches or less, and can have some configurations of an approximately 9 inch width.

Referring to FIG. 22, the monolithic backbone 420 can be incorporated to define a portion of the frame 20. In one configuration, the backbone 420 is a generally planar member with a pair of depending flanges 422 along each edge of the backbone. The upper surface of the backbone 420 includes a plurality of upper T-slots 424 for cooperatively engaging a beam or structural support engaging mechanism such as clips, brackets or vice type engagement. As seen in FIGS. 22 and 23, brackets can be located in the upper slots 424 of the backbone 420. The brackets 430 can include both fixed clips and moveable clips, or moveable clips. The moveable brackets 430 are linearly translatable along the length of the T-slot 424 to allow selective engagement with the beam (or structural support).

As seen in FIG. 59, the backbone 420 can be formed in an alternative configuration, wherein depending flanges are formed in the backbone to extend within the channel of the backbone. In addition, the backbone 420 can include lateral flanges for engaging a fastening plate securing the slide bearing to the backbone. The alternative backbone 420 also includes a longitudinally extending seat or shoulder for engaging a corresponding surface of the housing.

Referring to FIGS. 22, 23A and 23B, the brackets 430 can be in the form of L, C, or J brackets. Preferably, these brackets 430 include a root 432 sized to be slidably received within corresponding slots 424 of the upper surface of the backbone 420. A fastener such as a thumbscrew is disposed through the root 432 and can be selectively actuated to fix the position of the bracket 430 relative to backbone 420. As the brackets 430 can be readily disposed along the corresponding slots 424, any of a variety of beam sizes can be accommodated. Further, as the brackets 430 can be readily disposed into a retaining position, the operable engagement of the lift assembly 10 and the corresponding support beam does not require premeasurement or preassembly. That is, the lift assembly 10 can effectively be clipped upon to a respective support beam and secured in place.

The underside of the backbone 420 includes a plurality of lower T-shape slots 426 for cooperatively engaging mounts or the drive mechanism or the control components directly. Further, as seen in FIGS. 22, 23 and 34, a terminal end of the depending flanges 422 includes a groove 423. Preferably, the groove 423 is sized to cooperatively engage a corresponding upper portion of the housing 210 such that the housing then encloses the components of the lift assembly 10 in conjunction with the backbone 420.

It is also understood a bridge or truss can engage the backbone 420 to enhance rigidity as well provide mounting for the enclosing housing 210.

The frame 20 also includes or cooperatively engages mounts for the drive mechanism 100 and linear bearings 500 for the drum 160. As seen in FIGS. 52-54, the linear bearings include a fixed sleeve 496 for allowing axial and rotational movement relative to a shaft. Thus, the linear rotating bearings 500 translate along the longitudinal dimension of the shaft, and allow the shaft to rotate relative to the bearing. In one configuration, the components, such as the drive mechanism and drum mounts include tabs or fingers configured for cooperatively engaging the lower slots 426. The tabs or fingers can include any of a variety of mechanisms for fixing a position along the slot. That is, expansion wedges, as well as set screws or clamps can be used to fix the location of components relative to the backbone 420.

The frame 20 includes a pair of rails for supporting the drive mechanism, a translating shaft and a threaded keeper. The rails can be directly affixed to the backbone 420. As set forth in the description of the drive mechanism 100, the drive mechanism is connected to the frame 20 for translation with the drum along the axis of rotation of the drum as provided by the bearings 500.

In the first configuration of the frame 20, the frame has an overall length of approximately 10 feet, a width of approximately 11 inches and a height of approximately 17 inches. However, the length can be approximately 12 feet with an approximately 9 inch width and a height of approximately 19 inches.

The frame 20 includes a head block mount 30 for locating the head blocks in a fixed position relative to the frame. In one construction, the head block mount 30 is a helical mount concentric with the axis of drum rotation. The inclination of the helical mount is at least partially determined by the length of the drum 160, the size of associated head blocks 80, the spacing of the installed frame and the number of cables to be drawn from the drum. Thus, the helical head block mount 30 may extend from approximately 5° of the drum to over 180°. The helical mounting allows the head blocks 80 to overlap along the longitudinal axis of drum rotation, without creating interfering cable paths.

Although the helical mount 30 is shown as a continuous curvilinear strut, it is understood a plurality of separate mounts can be employed, wherein the separate mounts are selected to define a helical or a serpentine path about the axis of rotation of the drum 160.

In a further construction, the head block mounts 30 can be merely radially spaced about the axis of drum rotation at a common longitudinal position along the axis of drum rotation. That is, rather than being disposed along the longitudinal axis of the drum 160, the head block mounts 30 are located at a fixed longitudinal position of the drum. However, it has been found that the width of the frame 20 can be reduced by radially and longitudinally displacing the head blocks 80 along a serpentine path about the axis of drum rotation, wherein the head blocks lie within approximately 100°0 and preferably 90° of each other.

In an alternative configuration, the head blocks 80 are connected to the backbone 420, via the lower slots 426. Thus, the head blocks 80 are individually connected to the backbone 420, and can be displaced about a horizontal axis of rotation to align a corresponding cable path with a section of the drum 160.

As shown in FIGS. 1 and 2, in the seven-cable configuration, the lift assembly 10 includes two internal and five external loft blocks 220. The internal loft blocks 220 are located within the frame 20 and the external loft blocks 220 are operably mounted outside the frame, as seen in FIG. 1. However, the lift assembly 10 can be configured to locate a plurality of external loft blocks 220 from each end of the frame. That is, two or more loft blocks 220 may be spaced from one end of the frame 20 and two or more loft blocks may be spaced from the remaining end of the frame.

In addition, depending upon the configuration of the lift assembly 10, the number of internal loft blocks 220 can range from none to one, two, three or more.

Hoisting Adapter

In addition, the frame 20 may include a hoisting adapter 26 or mounts for releaseably engaging the hoisting adapter. It is anticipated a plurality of hoisting adapters can be employed, as at least partially dictated by the size of the frame 20 and the configuration of the building. The hoisting adapter 26 includes a sheave 28, such as a loft block connected to spaced apart locations of the frame. The hoisting adapter 26 can also include a clip assembly 40 for releaseably engaging a beam of the building. The hoisting adapter 26 is selected so that the frame may be hoisted to an operable location and connected to the building by additional clip assemblies 40.

Head Blocks

A plurality of head blocks 80 is connected to the head block mount 30 or the backbone 420. The number of head blocks corresponds to the number of cables 14 to be controlled by the lift assembly 10. The head blocks 80 provide a guide surface about which the cable path changes direction from the drum 160 to a generally horizontal direction. However, it is understood the cable path within the housing (lift assembly) can be inclined between a given head block and passing from the housing 210. The guide surface may be in the form of sliding surface or a moving surface that moves corresponding to travel of the cable. Each head block 80 draws cable 14 from a corresponding winding section along a tangent to the drum 160. The angle between the head block 80 and the respective cable take off point from the drum 160 may be repeated by each of the head blocks 80 relative to the drum.

As the head blocks 80 can be mounted to the head block mount 30, such as the helical mount, the head blocks can overlap along the axis of drum rotation. The overlap allows for size reduction in the lift assembly 10. That is, a helical mounting of the head blocks 80 allows the head blocks to overlap radially as well as longitudinally relative to the axis of drum rotation. By overlapping radially, the plurality of head blocks 80 can be operably located within a portion of the drum circumference, and preferably within a 90° arc, Thus, the operable location of the head blocks 80 can be accommodated within a diameter of the drum. By disposing the head blocks within a dimension substantially equal to the diameter of the drum 160, the frame 20 width can be reduced to substantially that of the drum diameter.

Each head block 80 generally includes a pair of side plates, a shaft extending between the side plates, accompanying bearings between the plates and the shaft, and a pulley (sheave) connected to the shaft for rotation relative to the side plates. The head block 80 may also include a footing for connecting the head block to the head block mount and hence the frame. It is understood the head blocks 80 may have any of a variety of configurations such as guide surfaces or wheels that permit translation of the cable relative to the head block, and the present invention is not limited to a particular type of construction of the head block, Drive Mechanism The drive mechanism 100 is operably connected to the drum 160 for rotating the drum and translating the drum along its longitudinal axis, the axis of drum rotation. Referring to FIGS. 4*a* and 4*b*, the drive mechanism 100 includes a motor 110, such as an electric motor, and a gearbox 120 for transferring rotational motion of the motor to a drive shaft 114. The motor 110 may be any of a variety of high torque electric motors such as ac inverter duty motors, dc or servo motors as well as hydraulic motors.

The gearbox 120 is selected to rotate the drive shaft 114, and the drum, in a winding (raising) rotation and an unwinding (lowering) rotation. The gearing of the gearbox 120 is at least partially determined by the anticipated loading, the desired lifting rates (speeds) and the motor. A typical gearbox is manufactured by SEW or Emerson.

The drive mechanism 100 may be connected to the frame 20 and particularly the backbone 420 such that the drive mechanism and the drum 160 translate relative to the frame (backbone) during rotation of the drum. Preferably, the drive mechanism 100 and the frame 20 (backbone 420) are sized so that the drive mechanism is enclosed by the housing 210. Alternatively, the drive mechanism 100 may be connected to a platform that slides outside the frame 20 and thus translates along the axis of rotation with the drum. The choice for connecting the drive mechanism 100 to the frame 20 is at least partially determined the intended operating parameters and manufacturing considerations.

In the construction shown in FIGS. 4*a* and 4*b*, the drive shaft 114 includes a threaded drive portion. The drive portion may be formed by interconnecting a threaded rod to the shaft or forming the shaft with a threaded drive portion. The threaded drive portion is threadingly engaged with a keeper 115, which in turn is fixedly connected to the frame 20. The keeper 115 includes a threaded portion or a nut affixed to a plate which receives the threaded portion. That is, referring to FIG. 2, rotation of the shaft 114 not only rotates the drum 160, but the drum translates to the left or the right relative to the frame 20 and hence relative to the attached head blocks. As the drive mechanism 100 is attached to the drum 160 and attached to the frame 20 along a linear slide 111, the drive mechanism also translates along the axis of drum rotation relative to the frame. Referring to FIGS. 52-54, the linear bearings 500 control translation between the drum 160 and the frame 20 (backbone 420) along three mutually perpendicular axes.

The drive shaft 114 can have any of a variety of cross sections, however, a preferred construction of the drive shaft has a faceted cross section such as hexagonal.

Drum

The drum 160 is connected to the frame 20 (or backbone 420) for rotation relative to the frame about the axis of rotation and translation relative to the frame along the axis of rotation. Thus, the drum 160 is rotatable relative to the frame 20 (backbone 420) in a winding rotation with accompanying winding translation and an unwinding rotation with accompanying unwinding translation for winding or unwinding a length of cable 14 about a respective winding section.

As shown in FIGS. 1, 2, 24, 26 and 29-32, the drum 160 is horizontally mounted and includes the horizontal longitudinal axis of rotation. The drum 160 includes at least one winding section 162. The winding section 162 is a portion of the drum 160 constructed to receive a winding of the cable 14 for a given drop line. The winding section 162 may include a channeled or contoured surface for receiving the cable. Alternatively, the winding section 162 may be a smooth surface. The number of winding sections 162 corresponds to the number of cables 14 to be controlled by the lift assembly 10. As shown in FIG. 2, there are seven winding sections 162 on the shown drum.

Each winding section 162 is sized to retain a sufficient length of cable 14 to dispose a connected batten 12 between a fully lowered position and a fully raised position. As shown, a single winding of cable 14 is disposed on each winding section 162. However, it is contemplated that the drum 162 may be controlled to provide multiple layers of winding within a given winding section 162.

As shown in FIGS. 5-8, in one configuration of the lift assembly 10, the drum 160 is a modular construction. The drum 160 is formed of at least one segment 170. The drum segment 170 defines at least a portion of a winding section 162. In a first configuration, each drum segment 170 is formed from a pair of mating halves about the longitudinal axis. Each half includes an outer surface defining a portion of the winding section and an internal coupling surface. The internal coupling surface of the drum corresponds to a portion of the cross section of the drive shaft 114.

When assembled, the drum halves form an outer winding section and the internal coupling surface engages the faceted drive shaft for rotating the drum. Although the internal coupling surface of the drum can have a variety of configurations including slots, detents or teeth, a preferred construction employs a faceted drive 114 shaft such a triangular, square, hexagonal, octagonal cross-section.

Referring to FIG. 8 in an alternative modular construction of the drum 160, the segments 170 are formed of longitudinal lengths 176, each length being identical and defining a number of windings. Preferably, the longitudinal lengths 176 are identical and are assembled by friction fit to form a drum of a desired length. Each segment 170 includes a plurality of tabs 172 and corresponding recesses 174 for engaging additional segments. In this configuration, it has been found advantageous to dispose the longitudinal segments 176 about a substantially rigid core 180 such as an aluminum core as seen in FIG. 6. The core 180 provides structural rigidity for the segments 176. In addition, the core 180 does not require extensive manufacturing processes, and can be merely cut to length as necessary.

The modular construction of the drum 160 allows for the ready assembly of a variety of drum lengths. In a first configuration, the drum has an approximate 7-inch diameter with a 0.20 right handed helical pitch. In addition, the drum can be constructed of a plastic such as a thermosetting or thermoplastic material.

The drum 160 includes or is fixedly connected to the drive shaft 114, wherein the drive shaft is rotatably mounted relative to the frame 20.

In a further configuration seen in FIG. 50, the drum 160 can be formed of a core 462 with a surrounding sleeve 464. The core 462 can be an extruded profile having a constant cross section. In this configuration, the periphery of the core 462 can include at least one planar land area 466, and at least one radially extending anti-slip flange 468. The core 462 can also include a plurality of apertures or keyways 465 for engaging and retaining a length of cable 14.

The sleeve 464 includes an outer surface defining a spiral channel 472 for receiving the cable 14 and an inner surface having core engaging flanges 474.

As seen in FIG. 50, a locking ring 490 operably interconnects sleeves 464 along the core 462. The locking ring 490 includes a cable fitting 492 for contacting and directing a terminal end of a cable 14 to the aperture 465 in the core 462. In contrast to the generally circular cross section of the sleeve 464, the locking ring 490 includes a flat 494 corresponding to the land area 466 of the core 462. Preferably, the cable fitting 492 redirects the cable from a circumferential path to a radial path, to then engage one of the keyways 465 in the core 462.

It is contemplated the core 462 can be of an extruded construction such as a metal including aluminum, and the sleeve can be of a plastic, thermoplastic, thermoset or composite construction. Thus, weight can be reduced, while employing the strength of a metal core 462.

Bias Mechanism

Although the lift assembly 10 can be employed without requiring counterweights, it is contemplated that a bias mechanism can be employed to reduce the effective load to be raised by the lift assembly. For example, a torsion spring may be disposed between the shaft 114 and the frame 20 such that upon rotation of the shaft in a first direction (generally an unwinding direction), the torsion spring is biased and thus urges rotation of the drum in a winding or lifting rotation. Further, the present lift assembly 10 can be operably connected to an existing counterweight system, wherein the drive mechanism 100 actuates existing counterweights. However, it is understood that counterweights or bias mechanisms are not required for operation of the lift assembly 10.

Cable Path

The location of the head blocks 80 on helical head block mount 30 (or the backbone 420), the drum diameter and the cable sizing are selected to define a portion of the cable path and particularly a cable take off point. The cable path starts from a winding section 162 on the drum, to a tangential take off point from the winding about the drum 160. The cable path then extends to the respective head block 80. The cable path is redirected by the head block 80 to extend generally horizontally along the length of the frame 20 to a corresponding loft block 220, wherein the loft block may be internal or external to the frame. Each cable path includes the take-off point and a fleet angle, the angle between the take of point and the respective head block 80.

As a portion of the cable path for each cable extends generally parallel to the longitudinal axis of the drum, the take off points for the plurality of winding sections 162 are spaced about the circumference of the drum 160 due to the mounting of the head blocks 80 along the helical head block mount 30. In a first configuration of FIG. 2, the seven take off points are disposed within an approximate 90° arc of the drum periphery.

Depending upon the specific location of the external loft blocks and the head blocks 80, the cable path can be substantially horizontal or inclined, within the housing 210.

In general, an equal length of cable 14 is disposed about each winding section. The length of the cable paths between the take off point and the end of the frame 20 is different for different cable paths. Thus, a different length of cable 14 may extend from its respective take off point to the end of the frame 20. However, the lift assembly 10 is constructed so that an equal length of each cable 14 may be operably played from each winding section 162 of the lift assembly 10.

In one configuration to distribute loading, the sheaves, including the loft block and the head blocks can be rotatably connected to brackets 228', wherein the brackets are in turn pivotally connected to the backbone 420, sheave plate, or structural beam. In this configuration, the bracket 228' typically extends at an approximate 45° from the 90 degree change in cable path direction. In addition, the pivot axis of the bracket 228' is coaxial with the corresponding horizontal length of the cable path. Specifically, referring to FIG. 60, the brackets extend from a pivot adjacent the clamping mechanism to extend at an angle, such as approximately 45° shown in the Figure.

Referring to FIGS. 57 and 58, the backbone 420 is shown with the head blocks 80 (and loft blocks in FIG. 58). The backbone 420 is shown engaged with a portion of a structural beam, such as an over head beam.

Load Brake

The load brake 130 is located mechanically intermediate the drum 160 and the gearbox 120, as shown in FIG. 3. The load brake 130 includes a drive disc 132, a brake pad 134, a driven disc 136, and a peripheral ratchet 138, a tensioning axle 140 and a tensioning nut 146.

The drive disc 132 is connected for rotation with the drive shaft 114 in a one-to-one correspondence. That is, the drive disc 132 is fixedly attached to the drive shaft 114. The drive disc 132 includes a concentric threaded coupling 133. The driven disc 136 is fixably connected to the drum 160 for rotation with the drum. The driven disc 136 is fixably connected to the tensioning axle 140. The tensioning axle 140 extends from the driven disc 136. The tensioning axle 140 includes or is fixably connected to a set of braking threads 141 and a spaced set of tensioning threads 143. The brake pad 134, friction disc, is disposed about the tensioning axle 140 intermediate the drive disc 132 and the driven disc 136 and preferably includes the peripheral ratchet 138, which is selectively engaged with a pawl 139. In one configuration shown in FIG. 51, two pawls are employed, wherein the pawls are spaced such that as one pawl passes over the crest of a tooth, the remaining pawl is contacting the slope of a tooth. This effectively halves the amount of rotation that can occur before the brake engages.

Further, to reduce noise of operation, each pawl 139 is held out of engagement with the ratchet 138 during raising of the batten. In one configuration is pawl pivots relative to the ratchet and a bias member such a spring urges the pawl out of engagement with the ratchet. Upon rotation of the drum in the unwind (or lowering) direction, a friction pad on the arm of the pawl in contact with the disk, such that rotation of the disk causes the pawl to rotate and engage the ratchet. As the pawl 139 engages the ratchet, the brake disks (pads) screw together, from the opposite threads and the braking is initiated. In addition, as seen in FIG. 51 heat sinks 137 can be thermally coupled to each of the disks 132' and 136'.

To assemble the load brake 130, the tensioning axle 140 is disposed through a corresponding aperture in the gearbox 120 such that the tensioning threads 143 protrude from the gearbox. The braking threads 141 engage the threaded coupling 133 of the drive disc 132. The tensioning nut 146 is disposed on the tensioning threads 143. The brake pad 134 is thus disposed between the drive disc 132 and the driven disc 136 to provide a friction surface to each of the discs.

In rotating the motor 110 in a raising or winding direction, the braking threads 141 screw into the corresponding threaded coupler 133 on the drive disc 132, thereby causing the driven disc 136 and the drive disc 132 to compress the brake pad 134. That is, the longitudinal distance between the drive disc 132 and the driven disc 136 decreases. The drive disk 132, the brake pad 134 and the driven disc 136 thus turn as a unit as the cable 14 is wound upon the drum 160.

To lower or unwind cable 14 from the drum 160, the motor 110 and hence drive disc 132 are rotated in the opposite direction. Upon initiation of this direction rotation, the pawl 139 engages the ratchet 138 to preclude rotation of the brake pad 134. As the drive disc 132 is rotated by the motor 110 in the lowering direction, the braking threads 141 tend to cause the driven disc 136 to move away from the drive disc 132 and hence the brake pad 134, thus allowing the load on the drum 160 to rotate the drum in an unwinding direction. Upon terminating rotation of the drive disc 132 in the lowering direction of rotation, the load on the cable 14 causes the drum 160 and hence driven disc 136 to thread the braking threads 141 further into the coupler 133 against the now fixed braking pad 134 thereby terminating the unwinding rotation of the drum.

The tensioning nut 146 is used to determine the degree of release of the driven disc 136 from the brake pad 134. The tensioning nut 146 can also be used to accommodate wear in the brake pad 134. The present configuration thus provides a general balance between the motor induced rotation of the drive disc 132 in the unwinding direction and the torque generated by the load on the cable 14 tending to apply a braking force as the driven disc 136 is threaded toward the drive disc 132.

It is further contemplated the brake surfaces of load brake 130, or the load brake itself, could be disposed within a liquid bath to assist in temperature regulation of the components. While the bath could be exposed to a radiator or secondary cooling system, it is believed passive immersion of the components within a liquid bath, such as oil, will assist in reducing temperature spikes for the components. It is also contemplated that the heat sinks can be thermally coupled to the brake disks to dissipate heat.

An alternative construction of the load brake 130 is shown in FIG. 51, wherein corresponding elements are indicated with a "'" designation. In the load brake 130'of FIG. 51, the same operating principles as the brake of FIG. 3 are employed. However, in the configuration of FIG. 51, heat sinks (or dissipaters) 145' can be thermally coupled to the drive disc 132' and the driven disc 136' to absorb heat during operation of the hoist. In addition, the alternative embodiment can include a second, or redundant pawl 139".

Clip Assembly

The frame 20 and external loft blocks 220 are mounted to the building by at least one adjustable clip assembly 40. Each clip assembly 40 includes a J-shaped sleeve 50, a retainer 60 and a J-shaped slider 70. The sleeve 50 and the slider 70 each have a closed end and a leg. The closed end of the sleeve 50 and the slider 70 are constructed to engage the flange of a beam, as shown in FIG. 1.

The leg of the sleeve 50 is sized to slideably receive the retainer 60 and a section of the leg of the slider 70. The sleeve 50 includes a plurality of inwardly projecting teeth 52 at regularly spaced distances along the longitudinal dimension of the leg of the sleeve.

The retainer 60 is sized to be slideably received within the leg of the sleeve 50. The retainer 60 includes a pair of opposing slots 63 as shown in FIG. 9. A capture bar 62 having corresponding ears 64 is disposed within the slots 63. The slots 63 in the retainer 60 and the ears 64 of the capture bar 62 are sized to permit the vertical displacement of the capture bar between a lower capture position and a raised release position. The capture bar 62 is sized to engage the teeth 52 of the sleeve 50 in the capture position and be disposed above the teeth in the raised position, whereby the teeth can pass under the capture bar. The retainer 60 further includes a threaded capture nut 66 fixed relative to the retainer.

The slider 70 is connected to the retainer 60 by a threaded shaft 72. The threaded shaft 72 is rotatably mounted to the slider 70 and includes an exposed end 76 for selective rotation of the shaft. The rotation of the threaded shaft 72 may be accomplished by a Phillips or regular screw head, a hex-head or any similar structure. The threaded shaft 72, the retainer 60 and the slider 70 are selected to permit the retainer to be spaced from the slider between a maximum distance approximately equal to the distance between adjacent teeth 52 in the sleeve 50, and a minimum distance, where the retainer abuts the slider.

In addition, the sleeve 50 includes an elongate slot 53 extending along the length of the leg having the teeth 52. The slot 53 allows an operator to contact the capture bar 62 and urge the capture bar upward to the raised release position thus allowing the sleeve 50 and the retainer 60/slider 70 to be moved relative to each other and the beam, thereby allowing either release of the clip assembly 40 or readjustment to a different sized beam section. In a preferred construction, the sleeve 50, the retainer 60 and the slider 70 are sized to accommodate the beam flanges having a 4" to a 10" span. The sleeve 50, the retainer 60 and the slider 70 are formed of ⅛" stamped steel.

As set forth, the brackets 430 can be used to cooperatively engage the backbone 420 with the structural beams.

Alternative clip assemblies shown in FIG. 61, include a pair of flange engaging mounts interconnected by a threaded fastener. Each mount extends along a length of an edge of the structural beam flange. Each mount can include a hook for engaging the lateral depending flanges of the backbone. The mounts are selectively drawn together by the threaded fastener to operably engage the structural beam. Thus, the clip assemblies can accommodate various structural beam spacings with a range of backbone, and hence sizes of the lift assembly 10.

Control-Power Strip

As shown in FIG. 2, the present invention also contemplates a control/power strip 90 sized to be disposed between the flanges of a beam. The control strip 90 includes a housing 92 and cabling for supplying electricity power as well as control signals. The housing 92 provides support to the cabling and can substantially enclose the cabling or merely provide for retention of the cabling. Typically, the control strip 90 includes interconnects at 12 inch centers for engaging a plurality of frames 20. The control strip 90 is attached to the beam by any of a variety of mechanisms including adhesives, threaded fasteners as well as clamps.

Loft Block

As shown in FIG. 1, the plurality of loft blocks 220 corresponding to the plurality of head blocks 80, is connected to the building in a spaced relation from the frame 20. The loft blocks 220 are employed to define the portion of the cable path from a generally horizontal path section that extends from the corresponding head block 80 to a generally vertical path section that extends to the batten 12 or load. Depending upon the length of the batten 12 and the width of the stage, there may be as few as one or two loft blocks 220 or as many as six, eight, twelve or more.

As shown in FIG. 2, two internal loft blocks 220 are located within the frame 20 to allow for cables 14 to pass downward within the footprint of the frame. Thus, the present invention reduces the need for wing space in a building to accommodate counterweight systems.

Typically, at each loft blocks 220, there is a load cable 222 and a passing cable 224, wherein the load cable is the cable redirected by the loft block to extend downward to the batten 12 and the passing cable continues in a generally horizontal direction to the subsequent loft block. In a preferred configuration, the loft blocks 220 accommodate the load cable 222 as well as any passing cables 224.

Referring to FIG. 10, each loft blocks 220 includes a load sheave 230, an optional carrier sheave 240, an upstream guide 250, a downstream guide 260 and a pair of side plates 270. The load sheave 230 is constructed to engage and track the load cable 222, and the carrier or idler sheave 240 is constructed for supporting the passing (through) cable 224. It is contemplated the load sheave 230 and the carrier sheave 240 may be a single unit having a track for the load cable 222 and separated track or tracks for the passing cables 224. In one construction, the carrier sheave 240 is a separate component that engages the load sheave 230 in a friction fit, wherein the load sheave and the carrier sheave rotate together. This construction allows the loft block 220 to be readily constructed with or without the carrier sheave 240 as necessary. Alternatively, the load sheave 230 and the carrier sheave 240 can be separately rotatable members.

The upstream guide 250 includes a through cable inlet 251 and a load cable inlet 253, wherein the through cable inlet is aligned with the carrier sheave 240 and the load cable inlet is aligned with the load sheave 230. The upstream guide 250 is configured to reduce a jumping or grabbing of the cables 14 in their respective sheave assembly. The downstream guide 260 is located about the exiting path of load cable 220. Typically, the downstream guide includes a load cable exit aperture 263.

The side plates are sized to engage the load and carrier sheaves 230, 240 as well as the upstream and downstream guides 250, 260 to form a substantially enclosed housing for the cables 14. The side plate 270 includes a peripheral channel 273 for engaging and retaining the upstream guide 250 and the downstream guide 260. The peripheral channels 273 include an access slot 275 sized to pass the upstream guide 250 and the downstream guide 260 therethrough. In the operating alignment, the peripheral channel 273 retains the upstream guide 250 and the downstream guide 260. However, the side plates 270 can be rotated to align the access slot 275 with the upstream guide 250 or the downstream guide 260 so that the guides can be removed from the side plates. The loft block 220 thereby allows components to be removed without requiring pulling the cables 14 through and subsequent re-cabling.

The loft block 220 includes a shaft about which the load sheave 230, the carrier sheave 240 (if used), and the side plates 270 are concentrically mounted.

The loft block 220 engages a coupling bracket 226, wherein the coupling bracket maybe joined to a clip assembly 40 such that the coupling bracket is moved about a pair of orthogonal axis to accommodate tolerances in the building.

As seen in FIGS. 35-49, an alternative structure for the loft block 220 are shown. The loft block of FIGS. 35-49 is designated with "'" to indicate structure corresponding to previously described elements. The loft blocks 220' of FIGS. 35-49 include a coupling bracket 226' having an accurate closed end 228. The closed end 228 is selected to cooperatively engage a mount (connected to the lower slots 426) to allow rotation of the bracket 226', and hence loft block 2201 about an axis parallel to the longitudinal axis of the drum 160.

In addition, the loft blocks 220' include cable path guides 250', 260' that are retained relative to the side plates 270' by a snap or friction fit. The snap fit allows assembly of the side plate 270' and any associated sleeves 250', 260' within the bracket 226'. Thus, a cable path guide can thus be operatively engaged with the bracket in a plurality of positions.

As seen in FIGS. 35-49, the cable path guides 250', 260' can define a path for the cable 14 entering and exiting (as a drop line or a through line) the loft block.

Referring to FIGS. 41-46, the cable path guide 250' can be configured to accommodate a plurality of cables. The cross section of the multi cable path guide allows the cables to be at least partially stacked within the guide. The stacking provides a reduced cross sectional area occupied by the cables.

In the alternative configuration of the loft blocks 220' of FIGS. 41-43, the carrier sheave is replaced by a static cable path guide 255, which is fixed relative to the coupling bracket 226'. The upstream guide 250' contains the through cables. The downstream guide 260' directs the load cables to the batten (or load)

Controller

It is further contemplated the present invention may be employed in connection with a controller 200 for controlling the drive mechanism 100. Specifically, the controller 200 can be a dedicated device or alternatively can include software for running on a personal computer, wherein control signals are generated for the lift assembly 10.

Stop Sensor

A proximity sensor or detector 280 can be fixed relative to the load, the batten 12 or the elements connected to the batten 12. The sensor 280 can be any of a variety of commercially available devices including infra red, ultrasound or proximity sensor. The sensor 280 is operably connectable to the controller by a wire or wireless connection such as infrared. The sensor 280 is configured to detect an obstacle in the path of the batten 12 moving in either or both the lowering direction or the raising direction. The sensor 280 provides a signal such that the controller 200 terminates rotation of the motor 110 and hence stops rotation of the drum 160 and movement of the batten 12 upon the sensing of an obstacle.

It is contemplated the sensor 280 may be connected to the batten 12, wherein the sensor includes an extendable tether 282 sized to locate the sensor 280 on a portion of the load carried by the batten. Thus, the sensor 280 can be operably located with respect to the batten 12 or the load. Preferably, the sensor is sized and colored to reduce visibility by a viewing audience. It is also understood the sensor can be selected to preclude the batten from contacting the deck, floor or stage.

Trim Adjustment

Referring to FIG. 11, the present invention further provides for a trim adjustment 290. That is, the relatively fine adjustment of the length of cable in the drop line section of the cable path.

In a first configuration of the trim adjustment 290, the structure is sized and selected to be disposed within the cross-sectional area of the batten 12. Thus, the trim adjustment 290 is substantially unobservable to the audience. The trim adjustment can be located within a length of the batten 12, or form a portion of the batten such as a splice or coupler.

The trim adjustment 290 includes a translator 292 that is rotatably mounted to the batten 12 along its longitudinal dimension and includes a threaded section. The trim adjustment 290 further includes a rider 294 threadedly engaged with the threaded section of the translator 292, such that upon rotation of the translator, the rider is linear disposed along the translator.

The cable 14 is fixedly connected to the rider 294 such that is the rider is translated relative to the batten 12, additional cable 14 is either drawn into the batten or is passed from the batten.

Rotation of the translator 292 is provided by a user interface 296 such as a socket, hex head or screw interface. Typically, the user interface includes a universal joint 298 such that the interface may be actuated from a non-collinear orientation with the translator.

While the (linear) translator 292 and associated rider 294 are shown in the first configuration, it is understood that a variety of alternative mechanisms may be employed such as ratchets and pawls, pistons, including hydraulic or pneumatic as well as drum systems for taking up and paying out a length of cable 14 within a cross-sectional area of a batten 12 to function as trim adjustment height in a rigging system.

Distributed Control Logic

Referring to FIGS. 14 and 15, control of a given lift assembly 10, and particularly the drive mechanism 100 or motor 110 can be accomplished by a dedicated processor 300 located within the enclosed frame or housing 210. Generally, each lift assembly 10 includes the dedicated processor 300, or smart drive, such as a 32 bit RISC processor. The processor 300 is operably connected to a remotely located master drive processor 362 in the master control cabinet 360, as well as the drive mechanism 100, and specifically the electric motor, controls the variable speed of the motor. The master drive processor 362 is configured, or includes code, to perform a number of functions, including, but not limited to: queuing functions of multiple lift assemblies 10; grouping of multiple lift assemblies; communication with any other operably interconnected lift assembly to determine operating parameters and location of a load on the corresponding lift assembly.

The dedicated processor 300 provides individual control of the individual associated lift assembly; timing or duration of a particular drive state; control of the motor to locate the connected load at a given or predetermined; translating a load at a specific speed (velocity); following a desired load translation velocity curve; an acceleration to a given speed as well as a deceleration to a given speed. The dedicated processor 300 is configured to perform at least two of the following: (i) a rotational velocity of the drum in a first rotational direction; (ii) a second rotational velocity of the drum in a different second rotational direction; (iii) an acceleration of drum rotation in the first rotational direction, (iv) a second acceleration of the drum in the second rotational direction, (v) a first amount of drum rotation in the first rotational direction, (vi) a second amount of drum rotation in the second rotational direction, and (vii) drum rotation corresponding to a drum rotation in another lift assembly. The master drive processor 362 includes the ability to communicate with interconnected lift assemblies 10 and to initiate a responsive movement in the specific lift assembly in a predetermined or coordinated manner.

Each lift assembly 10 includes a low voltage (LV)/control input 312 for signaling with a remotely spaced central controller 400 such as the master drive processor 362; a communication line input 314 for providing operable communication between and among a plurality of lift assemblies, and a main power inlet 316 for receiving high voltage power for actuating the drive mechanism 110 as well as the processor 300.

In addition, each lift assembly 10 can include a break resister operably connected to the processor. The break resistor bleeds off power intermittently generated by the lift assembly. For example, when a load is lowered at a relatively low velocity, gravity urges the load downward at a greater velocity. The motor functions as a brake, and power is generated. This excess (generated) power is passed through the brake resistor to be dissipated as heat.

Referring to FIG. 15, a plurality of lift assemblies (V1, V2, V3 . . . Vn) can be operably interconnected within a given bus system 330. Preferably, low voltage and communication wiring is disposed within a first (low voltage) bus 332 and the high voltage wiring is disposed within a second (high voltage) bus 334, wherein there is sufficient spacing or shielding between the buses to substantially preclude electromagnetic interference. For each position for interconnecting a given lift assembly 10, a low voltage lead line 336, communication lead line 338, and high voltage lead line 340 can be connected to the respective bus. The lead lines 336, 338, 340 terminate in fittings for cooperatively engaging at the corresponding ports 312, 314, 316 in the given lift assembly 10.

As seen in FIG. 16, the wire trays are disposed along a portion of an I beam and the lead lines 336, 338, 340 extend from the respective bus to cooperatively engage a given lift assembly 10.

Preferably, each of the low voltage, communication and high voltage bus systems are operably connected to the master control cabinet 360 which includes the master drive processor 362. The master drive processor 362 includes the programming and communication for the individual lift assemblies 10 and thus, provides a communication between and among the lift assemblies.

A user interface is provided by the automation center 380 which includes a standard lap top computer such as a Dell computer with a touch screen. The touch screen user interface allows an operator to group lift assemblies 10, queue instruction sets for individual or group lift assemblies as well as request the specific operating parameters including speed, velocity curves and accelerations as well as specific positions. These commands are transferred to the master control cabinet 360 and the master drive processor 362 which then instructs the individual lift assemblies correspondingly, wherein the processor 300 within each individual lift assembly 10 individually controls the corresponding drive mechanism 100 therein.

The low voltage and communication bus 332 and a high voltage bus 334 can be installed along a support structure such as an I beam. For installation of the lift assemblies 10, each lift assembly is merely cooperatively engaged with corresponding beam, typically adjacent the bus systems and a second spaced beam, and the corresponding lead lines 336, 338, 340 are interconnected between the bus and the given lift assembly. The master control cabinet 360, typically located near a service power inlet, and the automation center 380 located at a convenient stage location, automatically query the bus system to identify the number of lift assemblies and the status of each. The software allows an operator to select any group of lift assemblies 10 via the automation center 380 and group the lift assemblies and subsequently provide a single instruction for the lift assemblies to follow. The master drive processor 362 coordinates the operator instructions, and translates and forwards the commands to the proper assembly 10. The drive mechanism control instructions for each lift assembly are generated within the corresponding lift assembly 10, thereby reducing the complexity and demands of central controls.

As shown in the Figures, the motor as well as the drive control are disposed within the frame and hence within the enclosure 210. Therefore, the present configuration provides an essentially portable lift assembly 10 which can readily engage the support beam and operably interconnect additional lift assemblies and control system by plugging into the respective bus. That is, the control panel can be mounted to the wall at a convenient location and the user interface disposed a desired location, which can be American Disabilities Act compliant. The cabling, or bus, is typically preinstalled along the support beam to which the lift assembly 10 will be mounted. Therefore, to operably install a given lift assembly 10, the lift assembly is clipped to the respective support beam, and the cabling plugs into the lift assembly thereby communicating with the preinstalled bus.

Typically, the master drive processor 362 holds the grouping, queuing and sequencing programming. A cycle data loop is employed to continuously query the network (and each connected hoist assembly) for certain data, such as drive status. The query frequency can be set to increase, depending upon the status of a given lift assembly 10. That is, if the motor of a given lift assembly is operating, the query frequency can be increased to provide greater control from the master processor 362. The actual desired speed or position for a given lift assembly is input by the operator via the master control processor 362, and the profile of target, go and acceleration for the lift assembly is determined by the on board dedicated processor 300.

In addition, each lift assembly 10 can include hard limits for operation of the lift assembly. For example, the hard limits can include, but are not limited to maximum rotational velocity of the drum 160 (and hence lift and lower speeds); and maximum wound and unwound positions of the drum (and hence upper and lower position limits). The control system can also include programming or operator limits, such as an administer limit and then specific operator limits. Thus, control of the lift assembly can be tailored to the experience of the given operator.

Load Sensing Drum

In a further configuration, it is contemplated the drum 160 can be load sensing to determine a relative overloading of a given cable as well as an underloading or slack condition of the cable.

Referring to FIGS. 17 and 18, the drum 160 includes a rigid central core 460 and a plurality of winding sections 162.

In one configuration, each winding section 162 corresponds to the windings of a single cable. In construction, the load sensing drum includes the central core 460 connected to the drive mechanism for rotation in accordance with the drive mechanism. The core includes a plurality of radially extending fins 462. While the number of fins can be at least partially dictated by design considerations, the present configuration is shown with four fins.

Each winding section of the drum for a corresponding lift line is typically on the order of six to 24 inches long, depending on the length of cable and diameter of the drum. Each winding section includes a plurality of inwardly projecting ribs 163. Each winding drum is individually and independently connected to the core by a plurality of bias mechanisms such as springs and particularly coil springs 464. More particularly, the bias mechanisms interconnect the fins 462 of the core 460 to the inwardly projecting ribs 163 of the winding section.

In a nominal state, typically each lift assembly 10 is engaged with a batten or combination batten which produces a minimal load on each lift line cables.

At least one of the bias mechanisms, and preferably 2, 3 or 4, or more interconnecting the core 460 to a respective winding section are in an extended, or uncompressed state under the nominal load, or substantially unloaded condition. Thus, these "overload springs" resist the rotation of the winding drum relative to the core. Upon an excessive load being disposed on any given lift line (cable), the respective winding section will tend to rotate relative to the core (counter clockwise in FIG. 17) and thus compress the overload springs. Upon sufficient compression of the overload springs, a contact switch 468 is actuated thereby sending a signal to the processor and/or controller which can implement any of a variety of safety reactions, including halting of the lift assembly 10

Further, at least one slack spring interconnects a fin of the core to a corresponding rib of the winding drum. The slack spring tends to urge the winding section in a winding rotation, (clockwise as seen in FIG. 17). Upon the nominal load being removed from the lift line of any given winding section, the slack spring will urge the winding drum in the clockwise rotation relative to the core, thereby actuating a contact switch and causing the processor or control system to implement predetermine safety procedures such as termination of rotation.

The lift assembly 10 also includes an overload and slack line condition sensor. The overload and slack line sensors can be disposed within the frame and hence within the enclosure 210. The overload and slack line sensors can be operably connected to the rotatable drum, or disposed along a portion of the cable path inside the enclosure. As seen in FIGS. 17, the overload and slack line condition sensor can be disposed between relative portions of the rotatable drum. In this configuration, the overload and slack line condition sensor is operably connected to the controller. In an alternative configuration, the overload and slack line condition sensor is disposed adjacent a portion of the cable path either within the enclosure 210 or external to the enclosure such that upon movement of an intended cable outside of the cable path, the sensor is actuated and a control signal is sent to the controller 200 the processor 300 or the master processor 362.

Combination Batten

Referring to FIGS. 19-21, the load to be vertically translated by a lift assembly 10 can be connected to a combination batten 412. As seen in FIG. 19, the combination batten 412 has a cross sectional profile for providing sufficient rigidity along the length of the batten to reduce the cross sectional area of the batten and thus weight of the batten, as well as providing a curtain slide for lateral (horizontal) translation of a curtain relative to the batten. Specifically, referring to FIG. 19, the combination batten 412 includes a trim track 450 and a carriage track 470. Trim slides 440 are disposed within the trim track to engage the cable. As seen in FIGS. 20 and 21, the trim slides 440 include a pair of engaging brackets 442, 444 which selectively and cooperatively engage a threaded driver 446. By rotation of the driver, the brackets are drawn together or forced apart such that upon being drawn together, the trim slide can be disposed in any of a variety of locations along the longitudinal dimension of the trim track, and upon being forced apart, the brackets engage the portion of the combination batten defining the trim track, thereby fixing the position of the trim slide relative to the combination batten. The brackets 442, 444 include mating inclined (camming) surfaces 445, to increase or decrease a cross sectional dimension of the trim slide. As seen in FIGS. 20 and 21, a lower portion of the bottom trim bracket includes a curvilinear recess or channel for receiving a length of the cable. When the trim slide is disposed in the engaging/retaining configuration, the trim brackets are fixed relative to the combination batten 412 as well as fixedly securing the cable relative to the combination batten and the trim slide. Thus, by selective movement of the trim slides to accommodate a variable length of cable within the combination batten, the trim of the batten can be readily adjusted by selective actuation of the threaded coupler through an upper groove in the trim track.

The trim track 450 can define a pair of retaining shoulders 448 projecting inwardly in the trim track, and at least one trim bracket can include corresponding recesses for cooperatively engaging the shoulders to selectively engage the shoulders to assist in operably retaining the trim bracket relative to the combination batten.

Referring to FIG. 20, a carriage 480 can be disposed in the carriage track 470. Preferably, the carriage 480 includes at least one wheel set having two interconnected wheels 482, wherein the wheels are interconnected by an axle 484. As seen in FIG. 20, the axle 484 is exposed to an opening in the carriage track such that curtains and/or scenery can be affixed to the carriage wheel. As the wheel carriages readily roll along the carriage track to be disposed at any of a variety of locations along the combination batten, the associated curtain can be moved along the longitudinal direction of the combination batten.

Further, the carriage track 470 can also function to engage and hang scenery or lighting or equipment whose location does not need to be changed along the longitudinal dimension of the combination batten during use.

As seen in FIG. 26, it is further contemplated that the batten may include a pulley or a sheave 404 connected or affixed to the batten at the location of each lift line (drop line). In this configuration, the support beam overhead of the respective pulley on the batten includes a coupler for engaging the lift line, such as a terminal end of the lift line. Alternatively, the associated loft block 220 can include the coupler for engaging a length of the lift line, to affix the lift line relative to the loft block. Thus, the cable path extends from the drum 160 about a corresponding head block 80, about a corresponding loft block 220, vertically downward to pass about the pulley 404 affixed to the batten 12, and then vertically upward to the coupler on the support beam (or the loft block). This arrangement is effectively a double purchase, thereby doubling the capacity of the respective lift assembly, while reducing the range of motion for an attached load. This double purchase configuration is often is useful in the control of lighting. That is, a lighting batten typically needs only to travel within a limited range of motion, and is not required to descend to the stage.

Referring to FIGS. 55 and 56, an overload/underload sensor 510 is shown. As seen in FIG. 55, the overload/underload sensor 510 can collectively monitor a plurality of lines extending from a plurality of head blocks 80. Alternatively, in FIG. 56, the overload/underload can monitor a single line, via a single loft block 80.

As seen in FIG. 55, a plurality of head blocks 80 are affixed to a common rigid plate such as a sheave plate, or mount 502. The mount 502 is connected to the frame 20 by load cells 504. The load cells 504 are selected in view of the anticipated loads to be carried and required degree of precision. Although a pair of load cells 504 are shown, it is understood the mount 502 can be configured to use one, two or more load cells 504. The load cells 504 are operably connected to at least one of the processor 300, the master driver processor 362 or the central controller 400. Thus, the system can monitor the load of the cables 14, and can take action in response to load outside of given or predetermined parameters Also, control can be made by the controller including the dedicate processor 300 in response to a sudden change in loading.

As seen in FIG. 56, an individual head block 80 can include a load cell 504 in the form of a load pin 506. The load pin 506 is operably connected to at least one of the processor 300, the master drive processor 362 or the central controller 400. This configuration allows the load on each line 14 to be monitored so that appropriate action can be taken in response to an overload of the line or an underload (slack line).

Through cooperation of the load cells and the control software, operation of the lift assembly 10 can be restricted to be within predetermined thresholds. For example, upon the loading of a batten (lift assembly) the control software, via the load cell determines the load (or calibrates the given load). Subsequently, automatic operation of the lift assembly 10 is permitted within a known or predetermined variance from the calibrated load. Further, the control software can automatically cutoff or terminate motion of the lift assembly 10, if the sensed load is outside the predetermined variance from the calibrated load.

Installation

Preferably, the lift assembly 10 is constructed to accommodate a predetermined number of cables 14, and hence a corresponding number of winding sections 162 on the drum 160 and head blocks 80. In addition, upon shipment, the internal loft blocks 220 as well as the external loft blocks 220 are disposed within the frame 20. In addition, each cable 14 is pre-strung so that the cable topologically follows its own cable path.

The hoisting adapters 26 are threaded with the cable 14 and the separate clip assemblies 40 are connected to a pair of cables from the drum 160. The cable 14 is fed from the respective winding section and the clip assemblies are connected to the building. The drum 160 is then rotated to hoist the frame 20 to the installation position. Clip assemblies 40 connected to the frame 20 are connected to an adjacent beam of the building. The clip assemblies 40 are engaged with the respective beams and sufficiently tightened to retain the clip relative to the beam. The hoisting clip assemblies on the cables 14 are removed from the building and the cables, and the hoisting adapter are removed from the frame. The frame 20 is thus retained relative to the structure.

Upon the frame 20 being attached to the respective beams, the external loft blocks 220 are removed from the frame and sufficient cable 14 drawn from the drum 160 to locate the loft block adjacent to the respective structural beam. The loft block 220 is then connected to the beam by the clip assembly 40. The load cable 222 from each loft block 220 is operably connected to a batten 12 or load. The trim adjustment 290 is then employed to adjust the relative length of the drop line, as necessary.

As the head blocks 80 longitudinally overlap along the axis of rotation of the drum 160, the frame 20 has an approximate 9-11 inch width. Thus, a plurality of frames 20 can be connected to the building in an abutting relation with the drum axis in parallel to provide location on 12-inch centers as seen in FIG. 12. Alternatively, as shown in FIG. 13, as the frame 20 can be constructed to include the external loft blocks 220 in any relation to the internal loft blocks, the frames can be staggered along the width of the stage. That is, the second frame is spaced from the first frame in the longitudinal direction such that the ends of the sequential frames are spaced apart.

Further, it is believed the backbone 420 can provide enhanced rigidity such that upon cooperative engagement the lift assembly 10 with a pair of spaced support beams, the relative rigidity of the spaced support beams is increased. As seen in FIG. 28, upon cooperatively engaging a plurality of lift assemblies 10 (shown schematically) with either a pair of spaced support beams or selected pairs of a plurality of support beams, the support beams interconnected by the lift assemblies may exhibit an enhanced rigidity and a reduction of relative movement between the beams. This reduced relative motion of the support beams enhances the ability of the present system to control the location of a connected batten 12. The lift assemblies 10 can be engaged with a support beam such that adjacent lift assemblies abut each other along a longitudinal dimension. That is, the backbone 420 of one lift assembly can contact the backbone of an adjacent lift assembly along the edges of the backbones.

Thus, for lift assemblies 10 installed in an abutting relation, adjacent backbones 420 can contact each other and cooperate to reinforce the overall structure. It is also contemplated the edge of the backbone can be configured to engage an abutting backbone 420 along its length, thereby further enhancing the interconnection of the lift assemblies and the building. Referring to FIGS. 28, a plurality of lift assemblies 10 are shown operably installed in an abutting relation. It is believed, such installation of loft assemblies will reinforce the structure, which incorporates the support beams to which the lift assemblies are connected.

The modular design and distributed architecture allow for relatively quick installation of the present system. Specifically, the master control 360 is located at an accessible location, typically at stage level. The low voltage, high voltage (power) and communication lines (buses) can be readily installed in the intended areas. The lift assemblies 10 are then hoisted into place and the brackets 430 engaged with the adjacent beam. The lift assembly 10 is then connected to the bus, and the lift assembly is installed.

Operation

In operation, upon actuation of the motor 110, the drive shaft 114 and the drum 160 rotate in the unwind rotation. This rotation locks the brake pad 134 and threads the driven disc 136 away from the drive disc 132, which allows cable 14 from each winding section to be paid out from the drum 160 at the respective takeoff point.

The rotation of the shaft 114 which winds or unwinds cable 14 to or from the drum 160 also causes rotation of the threaded portion of the shaft. Rotation of the threaded portion relative to the keeper 115 induces a linear translation of the drum 160 along the axis of drum rotation during winding and unwinding rotation of the drum.

The threading of the threaded portion, the sizing of the drum 160 and the cable 14 are selected such that the fleet angle, or fleet angle limit, is maintained between each head block 80 and the takeoff point of the respective winding section 162. Thus, by longitudinally translating the drum 160 during unwinding and winding rotation, the fleet angle for each head block 80 and corresponding take off point in the winding section 162 is maintained.

As the fleet angles are automatically maintained, there is no need for a movable connection between a plurality of head blocks 80 along the helical mount and the frame to maintain a desired fleet angle.

In the bias mechanism configuration, as the drum 160 is rotated with an unwinding rotation, tension is increased in the torsion spring. Thus, upon rotation of the shaft and hence drum in the winding direction, the torsion spring assists in such rotation, thereby reducing the effect of weight of the load such as the batten and any accompanying equipment. This reduction in the effective load allows the sizing of the motor, and gearbox to the adjusted accordingly.

The master controller 362 and user interface allow an operator to input desired groupings, sequencing (control) of the lift assemblies. Commands from the master processor 362 are implemented by the processor 300 within each lift assembly. Thus, the dedicated processor 300 of a given lift assembly 10 only communicates with the master processor 362, and implements commanded rate and timing, while the master processor has fixed the sequencing or grouping.

Further, the master processor 362 continuously interrogates the processor 300 of each lift assembly 10 and can thus issue commands to an individual lift assembly as necessary. While the present master-slave relationship has been employed and which reduces required data transfer, it is understood a peer to peer relationship of the individual lift assemblies can be employed. However, the peer to peer relation requires substantially greater data transfers.

It is also contemplated each processor 300 (and hence lift assembly 10) can include the soft (controllable) limits within the hard (mechanical) limits. Such soft limits can include different levels of access, such as administrator set limits and specific operator set limits.

In the distributed control, the master processor 362 may issue a speed, acceleration and target position for the given lift assembly 10. The dedicated processor 300 within the given lift assembly 10 then generates a profile to implement the command.

It is also contemplated, the processor 300 in each lift assembly 10 can employ torque proving. For example, the motor develops a full holding torque at zero speed (no rotation of the drum 160), then a motor brake releases and the torque is transmitted to the drum 160. The processor 300 can learn a current (to the motor) necessary to move (rotate the drum), and thus requires such current, prior to implementing a subsequent commanded movement from the master processor 362.

In a further configuration, it is understood wireless control of at least the master processor 362 can be provided. It is contemplated such remote control would include an emergency stop for immediately halting operation of all the connected lift assemblies.

Although the present invention has been described in terms of particular embodiments, it is not limited to these embodiments. Alternative embodiments, configurations or modifications which will be encompassed by the invention can be made by those skilled in the embodiments, configurations, modifications or equivalents may be included in the spirit and scope of the invention, as defined by the appended claims.

The invention claimed is:

1. A lift assembly system for cooperatively engaging a plurality of overhead support structures, comprising:

(a) a first lift assembly connected to the plurality of support structures, the first lift assembly including a first rotatable drum and a first motor; and (b) a second lift assembly connected to the plurality of support structures, the second lift assembly including a second rotatable drum and a second motor, the second lift assembly abutting the first lift assembly along a longitudinal dimension of the first lift assembly and the second lift assembly.

2. The lift assembly of claim 1, wherein the first lift assembly includes a first dedicated processor and the second lift assembly includes a second dedicated processor.

3. The lift assembly of claim 2, further comprising a master processor spaced from the first lift assembly and the second lift assembly, the first dedicated processor and the second dedicated processor in communication with the master processor.

4. The lift assembly of claim 1, further comprising a first overload/underload sensor in the first lift assembly and a second overload/underload sensor in the second lift assembly.

5. A method of installing a lift assembly system comprising:

(a) connecting a first lift assembly to a first and a second overhead support beam; and (b) connecting a second lift assembly to the first and the second overhead support beams to abut the second lift assembly and the first lift assembly.

6. A lift assembly for cooperatively engaging spaced locations of an overhead structure, comprising:

(a) an elongate enclosure;

(b) a backbone connected to the enclosure;

(c) a coupler connected to the backbone to selectively engage the overhead structures;

(d) a drum located within the enclosure, the drum rotatably mounted to the backbone;

(e) a motor connected to the drum for rotating the drum;

(f) a first head block within the enclosure and connected to the backbone; and (g) a first loft block within the enclosure and connected to the backbone.

7. An improved lift system having at least a first and a second lift assembly, the first lift assembly having a first motor for moving a first load and the second lift assembly having a second motor for moving a second load, and second lift, the improvement comprising:

(a) a first dedicated control processor in the first lift assembly, the first dedicated control processor configured to provide at least one of a lift rate, acceleration and position of the first load;

(b) a second dedicated control processor in the second hoist assembly; and (c) a master processor remotely spaced from the first dedicated control processor and the second dedicated control processor and operably connected to the first dedicated control processor and the second control processor, the master processor configured to one of queue, group or sequence movement of the first load and the second load.

8. A lift assembly comprising:

(a) a housing;

(b) a drum located within the housing and rotatably mounted relative to the housing;

(c) a loft block connected to the housing; and (d) a load sensor operably located between the housing and the loft block for providing a signal corresponding to a load on the loft block.

9. A lift assembly, for selectively winding and unwinding a cable, the hoist assembly comprising:

(a) a frame;

(b) a drum rotatably mounted to the frame, the drum sized to retain a plurality of wraps of cable;

(c) a head block located to pace a length of cable about a portion of the had block; and (d) a load sensor intermediate the head block and the frame to provide a signal corresponding to a load on the cable.

10. The lift assembly of claim 9, wherein the load sensor is a load pin about which the head block can rotate.

11. The lift assembly of claim 9, wherein the signal corresponds to an underload and an overload load on the cable.

12. A lift assembly for selectively winding and unwinding a cable, the lift assembly comprising:

(a) a frame;

(b) a drum rotatably mounted to the frame;

(c) a plurality of head blocks;

(d) a mount connected to the plurality of head blocks; and (e) a load sensor operably intermediate the mount and the head blocks for providing a signal corresponding to a load on the mount.

13. A method of controlling a lift assembly, comprising:

(a) determining an initial loading one the lift assembly from a load sensor on the lift assembly; and (b) limiting operation of the lift assembly to within a predetermined variance from the initial loading.

14. The method of claim 13, further comprising providing an automatic actuation of the lift assembly, wherein automatic operation is precluded outside the predetermined variance from the initial loading.

15. A method of installing a lift assembly, comprising:

(a) locating a drum rotatable about an axis of rotation and translatable along the axis of rotation to dispose the axis of rotation horizontal; and (b) passing a plurality of lines from the drum about corresponding loft blocks to define a cable path in a vertical direction.

* * * * *